US010508539B2

(12) United States Patent
Haque et al.

(10) Patent No.: US 10,508,539 B2
(45) Date of Patent: Dec. 17, 2019

(54) LOGGING FRACTURE TOUGHNESS USING DRILL CUTTINGS

(71) Applicant: Saudi Arabian Oil Company, Dhahran (SA)

(72) Inventors: Mohammad H. Haque, Houston, TX (US); Younane N. Abousleiman, Norman, OK (US); Katherine Leigh Hull, Houston, TX (US); Yanhui Han, Katy, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/992,907

(22) Filed: May 30, 2018

(65) Prior Publication Data

US 2018/0347355 A1 Dec. 6, 2018

Related U.S. Application Data

(60) Provisional application No. 62/514,326, filed on Jun. 2, 2017, provisional application No. 62/515,840, filed on Jun. 6, 2017.

(51) Int. Cl.

| | |
|---|---|
| ***E21B 49/00*** | (2006.01) |
| ***E21B 7/00*** | (2006.01) |
| *E21B 43/26* | (2006.01) |

(52) U.S. Cl.

CPC ..... *E21B 49/005* (2013.01); *E21B 7/00* (2013.01); *E21B 43/26* (2013.01)

(58) Field of Classification Search

CPC ..... E21B 49/005; E21B 43/26; E21B 49/08; A61K 6/083; A61K 6/0023; A61K 6/00; G01N 2021/1727; G01N 2021/1761

See application file for complete search history.

(56) References Cited

U.S. PATENT DOCUMENTS 4,152,941 A 5/1979 Abou-Sayed et al.
4,299,120 A 11/1981 Barker
(Continued)

FOREIGN PATENT DOCUMENTS

JP 2011174808 A 9/2011
WO 0125597 A1 4/2001

OTHER PUBLICATIONS

Pascal Forquin, Laurent Rota, Yann Charles, Francois Hild, "A method to determine the macroscopic toughness scatter of brittle materials," 2004, Kluwer Academic Publishers, International Journal of Fracture, pp. 171-187. (Year: 2004).*
(Continued)

*Primary Examiner* — Mohamed Charioui
*Assistant Examiner* — Christine Y Liao
(74) *Attorney, Agent, or Firm* — Bracewell LLP; Constance G. Rhebergen; Christopher L. Drymalla

(57) ABSTRACT

Provided are systems and methods for determining fracture toughness of a subsurface geologic formation. Embodiments include collecting (from drilling fluid circulated into a wellbore during a drilling operation) a drill cutting generated by a drill bit cutting into a subsurface formation, preparing (from the drill cutting) a drill cutting specimen comprising a miniature single edge notch beam (SENB) having a specified length in the range of 1 millimeter (mm) to 100 mm, conducting a three-point bend testing of the drill cutting specimen to generate load-displacement measurements for the drill cutting specimen, and determining (based on the load-displacement measurements for the drill cutting specimen) a fracture toughness of the subsurface formation.

22 Claims, 11 Drawing Sheets

(56) References Cited

U.S. PATENT DOCUMENTS

| | | | | |
|---|---|---|---|---|
| 4,567,774 | A | 2/1986 | Manahan et al. | |
| 4,864,867 | A | 9/1989 | Manahan, Sr. | |
| 8,234,912 | B2 | 8/2012 | Suarez-Rivera et al. | |
| 9,128,210 | B2 | 9/2015 | Pomerantz | |
| 9,314,407 | B2 | 4/2016 | Blizzard et al. | |
| 2007/0185696 | A1* | 8/2007 | Moran | E21B 44/00 703/10 |
| 2015/0025815 | A1 | 1/2015 | Sebastiani et al. | |
| 2015/0034049 | A1 | 2/2015 | Matsui et al. | |
| 2016/0258266 | A1* | 9/2016 | Frick | B01D 3/007 |
| 2017/0066959 | A1 | 3/2017 | Hull et al. | |
| 2017/0067836 | A1 | 3/2017 | Hull et al. | |
| 2017/0335643 | A1* | 11/2017 | Allen | B03B 5/442 |
| 2018/0202263 | A1* | 7/2018 | Prasad | E21B 43/26 |

OTHER PUBLICATIONS

K. Khan and N.A. Al-Shayea, "Effect of Specimen Geometry and Testing Method on Mixed Mode I-II Fracture Toughness of a Limestone Rock from Saudi Arabia," 2000, Springer-Verlag, Rock Mechanics and Rock Engineering, pp. 179-209 (Year: 2000).*

Abousleiman, Younane et al.; "Geomechanics Field and Laboratory Characterization of Woodford Shale: The Next Gas Play" SPE 110120, SPE Annual Technical Conference & Exhibition in Anaheim, CA, Nov. 11-14, 2007; pp. 1-14.

ASTM International; "Standard Test Method for Linear-Elastic Plane-Strain Fracture Toughness Klc of Metallic Materials" Designation: E399-12 (2012); pp. 1-33.

Backers, Tobias; "Fracture Toughness Determination and Micromechanics of Rock Under Mode I and Mode II Loading" Doctoral Thesis, University of Potsdam, 2004; pp. 1-137.

Mehrabian, Amin et al.; "Geomechanics of Lost-Circulation Events and Wellbore-Strengthening Operations" SPE 174088, Dec. 2018 SPE Journal; pp. 1305-1316.

Zhu Xian-Kui et al.; "Review of fracture toughness (G, K, J, CTOD, CTOA) testing and standardization" Engineering Fracture Mechanics 85 (2012); pp. 1-46.

Ahmad et al., "Influence of specimen size and loading feature on fracture toughness of rocks", www.jeaconf.org, 2014, pp. 1-8.

International Search Report and Written Opinion for International Application No. PCT/US2018/035521; International Filing Date Jun. 1, 2018; dated Sep. 3, 2018 (pp. 1-13).

Chen, Zhixi et al.; "Determination of Rock Fracture Toughness and its Relationship with Acoustic Velocity" Int. J. Rock Mech. & Min. Sci. 34:3-4, paper No. 049; pp. 1-11.

Kataoka, M. et al.; "Size Effect in Fracture Toughness of Sandstone" Innovations in Applied and Theorectical Rock Mechanics, 13th International Congress of Rock Mechanics, May 10-13, 2015; pp. 1-8.

Shah, Surendra P.; "Determination of Fracture Parameters (KsIC and CTODc) of Plain Concrete Using Three-Point Send Tests" Materials and Structures, Jan. 23, 1990; pp. 1-5.

Srawley, John E.; "Wide Range Stress Intensity Factor Expressions for ASTM E399 Standard Fracture Toughness Speciments" NASA TM X-71881, Committee E-24 of the American Society for Testing and Materials, Orlando, FL, Mar. 22-26, 1976; pp. 1-5.

* cited by examiner

LOGGING FRACTURE TOUGHNESS USING DRILL CUTTINGS

RELATED CASES

This patent application claims the benefit of U.S. Provisional Patent Application No. 62/514,326 filed Jun. 2, 2017 titled "Logging Fracture Toughness Using Drill Cuttings", and U.S. Provisional Patent Application No. 62/515,840 filed Jun. 6, 2017 titled "Failure Behavior of Kerogen-Rich Shale (KRS) Composites at meso-scales", each of which is incorporated herein by reference.

FIELD

Embodiments relate generally to assessing geological formations, and more particularly to determining fracture toughness of a subsurface geological formation using drill cuttings extracted during drilling of a wellbore into the formation.

BACKGROUND

A well typically includes a borehole (or "wellbore") that is drilled into the earth to provide access to a geological formation below the earth's surface (or "subsurface formation"). A portion of a subsurface formation that contains (or is at least expected to contain) mineral deposits is often referred to as a "reservoir". A reservoir that contains hydrocarbons, such as oil and gas, is often referred to as a "hydrocarbon reservoir". A well can facilitate the extraction of natural resources, such as hydrocarbons, from a subsurface formation, facilitate the injection of fluids into the subsurface formation, and facilitate the evaluation and monitoring of the subsurface formation. In the petroleum industry, wells are often drilled to extract (or "produce") hydrocarbons, such as oil and gas, from hydrocarbon reservoirs located in subsurface formations. The term "oil well" is often used to describe a well designed to produce oil. In the case of an oil well, some natural gas is typically produced along with oil. Wells producing both oil and natural gas are sometimes referred to as "oil and gas wells" or "oil wells." The term "gas well" is normally reserved to describe a well designed to produce primarily natural gas. The term "hydrocarbon well" is often used to describe both oil and gas wells.

Creating a hydrocarbon well typically involves several stages, including drilling, completion and production. The drilling stage normally includes drilling a wellbore into a hydrocarbon reservoir in an effort to access hydrocarbons trapped in the reservoir. The drilling process is often facilitated by a drilling rig that sits at the earth's surface. The drilling rig provides for operating a drill bit; hoisting, lowering and turning drill pipe and tools; circulating drilling fluids; and generally controlling operations in the wellbore (or "downhole"). Drilling fluid (or "drilling mud") is typically circulated into the wellbore during drilling operations to provide hydrostatic pressure to prevent formation fluids from flowing into the wellbore, to cool and clean the drill bit, and to carry drill cuttings away from the drill bit and out of the wellbore. For example, drilling fluid is pumped down into the wellbore to circulate around the drill bit, capture drill cuttings created by the drill bit cutting into the formation rock, and carry the drill cuttings to the surface. The "dirty" drilling fluid is often filtered to remove drill cuttings and other debris from the drilling fluid to "clean" the drilling fluid so that it can be recirculated through the wellbore or otherwise reused. Referring again to the stage of creating a well, the completion stage typically involves making the well ready to produce hydrocarbons. In some instances, the completion stage includes lining portions of the wellbore and pumping fluids into the well to fracture, clean or otherwise prepare the reservoir to produce hydrocarbons. The production stage typically involves extracting and capturing (or "producing") hydrocarbons from the reservoir via the well. During the production stage, the drilling rig is normally removed and replaced with a collection of valves (or a "production tree"), that regulates pressure in the wellbore, controls production flow from the wellbore, and provides access to the wellbore. A lifting device, such as a pump jack, can provide hydrostatic lift that assists in drawing the hydrocarbons to the surface from the reservoir, especially in instances where the pressure in the well is so low that the hydrocarbons do not flow freely up the wellbore, to the surface. Flow from an outlet valve of the production tree is normally coupled to a distribution network, such as pipelines, storage tanks, and transport vehicles that transport the production to refineries and export terminals.

When developing a well it can be useful to know characteristics of the subsurface formation. Subsurface formation characteristics can, for example, be used for drilling operation planning and execution, hydraulic fracturing operation planning and execution, and wellbore stability planning and execution. Characteristics of interest can include mechanical properties, such as the fracture toughness of the subsurface formation. Fracture toughness defines the ability of a material, such as the rock of the subsurface formation, to resist fracture propagation when a crack is present. Fracture toughness can be used, for example, in hydraulic fracturing operation planning and execution to determine a pressure required to fracture the rock of the subsurface formation to facilitate the flow of hydrocarbons through the formation and into a well. Fracture toughness is also a critical material characteristic used in simulating lost circulation materials (LCM) management. LCM are often added to drilling fluids over the course of drilling to prevent loss of fluid to fractures in the formation, or provided as needed to seal fractures or zones in which significant losses have already occurred. Fracture toughness values can be of paramount importance in managing LCM and stabilizing a well due to lost mud and fracture gradient overshooting. Thus, fracture toughness logging information can enable optimization of drilling to prevent drilling mud losses. Traditional well assessment techniques, such as downhole logging operations, and core sampling operations are routinely employed to estimate the mechanical properties of subsurface formations.

SUMMARY

Applicants have recognized that traditional well assessment techniques can be costly, time consuming, and often have limited capability and accuracy. Downhole logging operations, such as sonic logging operations, can be expensive and may not provide suitable information for accurately determining fracture toughness of subsurface formations. Sonic logging operations often include lowering a sonic logging tool into a wellbore while transmitting seismic waves into the formation and measuring propagation of the seismic waves though the formation. The measurements can be used to determine the formation's capacity to transit seismic energy, which can, in turn, be used to determine characteristics of the formation, such as porosity. Core sampling operations can be costly and time consuming. A coring operation can include, for example, sending a core drill into the wellbore, cutting a cylindrical core sample of the formation from a given depth in the wellbore using the core drill, extracting the core drill and the core sample from the wellbore, transporting the core sample to a laboratory, and testing the core sample in the laboratory to determine various properties of the core sample and the formation at or near the depth from which the core sample was extracted. Such coring operations are often repeated at different depths to determine properties of the subsurface formation at the different depths. In the context of drilling operations, the coring operation typically requires suspending the drilling operation, removing the drill string (for example, including the drill pipe and the drill bit) from the wellbore, conducting the coring operation, re-running the drill string into the wellbore, and resuming drilling operations. Thus, the time and cost of a coring operation can include the time and cost of the coring operation itself, the time and cost to remove and re-run the drill string, as well as the added cost for operating the rig over the time period while drilling is suspended. In addition to the direct cost associated with logging and coring operations, each of these operations has an increased risk associated with running additional tools into the wellbore. For example, a tool can become lodged or otherwise lost downhole, which can lead to additional time and costs to retrieve the tool from the wellbore.

In the context of hydrocarbon wells, it can be important to understand the crack prorogation and failure characteristics of rock in the subsurface formation, especially for determining and executing efficient hydraulic fracturing operations. In reservoirs that include kerogen-rich shale (KRS), this can include understanding the effect of kerogen on the fracture toughness of the rock of the subsurface formation. As a composite material consisting of compacted clay particles, silt-sized grains and organic matter (OM), KRS is highly complex both structurally and mechanically. The OM, which is intertwined within the shale matrix, presents a particular challenge as it can be significantly more compliant than its surrounding minerals while at the same time having a significantly higher tensile strength. The mode-I fracture toughness and tensile failure behavior of KRS has been studied at a large scale (or "core-scale") using traditional rock mechanics assessment techniques, such as Brazilian tests, and at a very small scale (or "micro-scale") using nano-indentation test. A Brazilian test typically includes continuously applying an increasing load to the periphery of a disc shaped specimen until failure occurs. At a core-scale, the specimen may have a volume of about $10^{-5}$ cubic meters ($m^3$). A nano-indentation test involves pressing a relatively small tip into a relatively small volume of a specimen and determining a hardness of the specimen based on the maximum loading of the tip and the residual indentation area in the specimen. Applicants have recognized that core-scale testing, such as Brazilian testing, fails in precisely capturing the effects of OM due to its coarse resolution. Besides the limitations associated with collection and preparation of core sized specimens, it takes a greater amount of energy to open a fracture and, therefore, the individual effects of micro/nano scale organic matters cannot be isolated while measuring fracture toughness. Applicants have also recognized that, although the very fine resolution nano-indention may capture the behavior of isolated components, it can miss collective properties of the overall composite system. Thus, the scale of traditional rock mechanics assessment techniques can be too large or too small to accurately capture the properties of a KRS specimen.

Recognizing these and other shortcomings of traditional well assessment techniques and materials testing techniques, Applicants have developed novel systems and methods for determining fracture toughness of a subsurface geological formation using rock specimens fabricated from drill cuttings extracted during drilling of a wellbore into the formation. The techniques described can be employed, for example, over the course of a drilling operation to generate a log of fracture toughness across a depth interval of interest in the wellbore and the formation. With the combination of drill cuttings that are readily available, and the disclosed shaping and sizing of the specimens that can be formed from drill cuttings to accurately capture the properties of a KRS specimen, the proposed embodiments provide for accurately determining the fracture toughness of a subsurface formation including KRS, using readily available drill cuttings, and with little to no additional cost or delay in operating the well. Thus, the disclosed techniques can be employed, for example, to provide an accurate, real-time fracture toughness log for a well extending into a KRS formation, in a cost effective manner.

In some embodiments, fracture toughness testing is performed using miniature single edge notch beam (SENB) rock specimens prepared directly from drill cuttings representative of a layered geological rock formation. For example, during the drilling of a well, as the drilling fluid is circulated to the surface, drill cuttings (for example, including cuttings and cavings) are transported by the drilling fluid to the surface where they are collected (for example, on a shaker) in a raw unprocessed state. Some of the collected drill cuttings are formed into small specimens (for example, miniature SENB rock specimens), and the small specimens can be tested (for example, via a three-point bend test) to determine fracture toughness of the formation at the depth from which the corresponding drill cuttings were cut. Such a process of collecting drill cuttings, fabricating SENB specimens from the drill cuttings, and testing the SENB specimens, can be repeated for different depths to determine fracture toughness values for various depths in the wellbore and the formation, and the determined values for fracture toughness can be used to generate a log of fracture toughness across a depth interval of interest in the wellbore and the formation.

In some embodiments, the testing for a given depth includes the following: (1) obtaining multiple drill cutting samples directly from drilling fluid circulated to the surface during drilling of a wellbore at the given depth in a subsurface formation; (2) fabricating the samples into miniature SENB rock specimens; (3) testing the miniature SENB rock specimens in a three-point bending apparatus to obtain load-displacement measurements; and (5) determining fracture toughness of the formation at the given depth based on the load-displacement measurements.

In some embodiments, some of the specimens are prepared with a bedding plane parallel to the loading direction and some of the specimens are prepared with a bedding plane perpendicular to the loading direction, to obtain fracture toughness measurements for the respective orientations. This can enable a determination of fracture toughness measurements for the respective orientations, at the same location in the formation. In some embodiments, some of the specimens are treated with an oxidizer based fluid to isolate the effects of organic materials, such as kerogen, on the measurements, and some of the samples are untreated. The differences in measurements for the treated specimens and the untreated specimens can be used, for example, to determine the effects of organic material on overall fracture toughness measurements and directional values (or "anisotropy").

In some embodiments, the miniature SENB rock specimens are relatively small, having a volume in the range of about $10^{-8}$ $m^3$ to about $10^{-10}$ $m^3$. Such miniature SENB rock specimens can provide for isolation of the mechanical responses of different phases, especially the OM, from the clay particulates and minerals present in the specimen. In some embodiments, the miniature SENB rock specimens are of the millimeter (mm) scale, having a length in the range of about 1 mm to 100 mm. For example, each of the miniature SENB rock specimens may be a prismatic beam having a length (or "span") of about 8 mm, a width of about 3 mm, and a thickness of about 2.3 mm, and having a notch having a depth of about of about 1 mm. The size and shape of such specimens bridges the gap between the coarse resolution of the large scale (or "core-scale") samples used in some traditional rock mechanics assessment techniques, such as Brazilian tests, and the very fine resolution of the very small scale (or "micro-scale") samples used in some traditional rock mechanics assessment techniques, such as nano-indentation test, while still complying with one or both of American Society for Testing and Materials (ASTM) standards and International Society for Rock Mechanics (ISRM) standards. Applicants have recognized that miniature SENB rock specimens of the described size and scale can isolate the contributions from individual components, especially the OM, to the emergent, systematic fracturing behavior of KRS. That is, miniature SENB rock specimens in the millimeter scale, which can be fabricated from drill cuttings, can overcome issues associated with the coarse resolution of the large scale samples and the very fine resolution of the very small scale samples, thereby providing an accurate and efficient technique for determining fracture toughness of a subsurface formation as a wellbore is being drilled into the subsurface formation. As described, the determination of fracture toughness of a subsurface formation can be used for planning and executing various operations relating to the subsurface formation, such as planning and executing as hydraulic fracturing operations in the subsurface formation, or planning and executing drilling operations, such as LCM management operations, for wells drilled into the subsurface formation.

Provided in some embodiments is a method for logging fracture toughness of a geologic subsurface formation. The method includes the following: drilling, into a subsurface formation, a wellbore, the drilling including circulating a drilling fluid to capture drill cuttings generated by a drill bit cutting into the subsurface formation; collecting, from the drilling fluid, samples of the drill cuttings captured by the drilling fluid, a first subset of the drill cuttings being associated with a first depth in the subsurface formation, and a second subset of the drill cuttings being associated with a second depth in the subsurface formation; preparing, from the first subset of the drill cuttings, a first set of drill cutting specimens, each drill cutting specimen of the first set of drill cutting specimens including a miniature SENB having a specified length, the specified length in the range of 1 mm to 100 mm; preparing, from the second subset of the drill cuttings, a second set of drill cutting specimens, each drill cutting specimen of the second set of drill cutting specimens including a miniature SENB having the specified length; conducting three-point bend testing of the first set of drill cutting specimens to generate a first set of load-displacement measurements; determining, based on the first set of load-displacement measurements, a first fracture toughness for the first depth in the subsurface formation; conducting three-point bend testing of the second set of drill cutting specimens to generate a second set of load-displacement measurements; determining, based on the second set of load-displacement measurements, a second fracture toughness for the second depth in the subsurface formation; and generating a fracture toughness log for the subsurface formation including a mapping of fracture toughness versus depth in the formation, the mapping including a mapping of the first fracture toughness to the first depth in the subsurface formation, and a mapping of the second fracture toughness to the second depth in the subsurface formation.

In some embodiments, each of the drill cutting specimens includes a miniature SENB having a volume in the range of $10^{-8}$ $m^3$ to $10^{-10}$ $m^3$. In some embodiments, each of the drill cutting specimens includes a miniature SENB including a prismatic beam having a length (L) of 8 mm, a width (W) of 3 mm, a thickness (B) of 2.3 mm, and a notch having a notch depth (a) of 1 mm.

In some embodiments, a first subset of drill cutting specimens of the first set of drill cutting specimens includes a bedding plane having a first orientation, a second subset of drill cutting specimens of the first set of drill cutting specimens includes a bedding plane having a second orientation, a first subset of drill cutting specimens of the second set of drill cutting specimens includes a bedding plane having the first orientation, and a second subset of drill cutting specimens of the second set of drill cutting specimens includes a bedding plane having the second orientation. In some embodiments, the first orientation is aligned with a lateral axis of the drill cutting specimens such that the bedding plane is parallel to a loading direction of the drill cutting specimens in the three-point bend testing, and the second orientation is aligned with a longitudinal axis of the drill cutting specimens such that the bedding plane is perpendicular to a loading direction of the drill cutting specimens in the three-point bend testing.

In some embodiments, a first subset of drill cutting specimens of the first set of drill cutting specimens are treated with an oxidizer based fluid to isolate the effects of organic materials, a second subset of drill cutting specimens of the first set of drill cutting specimens are not treated with an oxidizer based fluid, a first subset of drill cutting specimens of the second set of drill cutting specimens are treated with an oxidizer based fluid to isolate the effects of organic materials, and a second subset of drill cutting specimens of the second set of drill cutting specimens are not treated with an oxidizer based fluid.

In some embodiments, the fracture toughness log is generated in real-time during the drilling of the wellbore. In some embodiments, the method further includes conducting drilling of the wellbore based on the fracture toughness log. In some embodiments, conducting drilling of the wellbore includes adding lost circulation materials (LCM) to drilling fluid circulated into the wellbore during drilling of the wellbore. In some embodiments, the method further includes conducting a well stimulation operation based on the fracture toughness log. In some embodiments, conducting a well stimulation operation includes conducing a fracturing operation including injecting a substance into the formation to fracture the formation.

Provided in some embodiments is a method of determining fracture toughness of a geologic subsurface formation. The method includes the following: drilling, into a subsurface formation, a wellbore, the drilling including circulating a drilling fluid to capture drill cuttings generated by a drill bit cutting into the subsurface formation; collecting, from the drilling fluid, samples of the drill cuttings captured by the drilling fluid, a first subset of the drill cuttings being associated with a first depth in the subsurface formation; preparing, from the first subset of the drill cuttings, a first set of drill cutting specimens, each drill cutting specimen of the first set of drill cutting specimens including a miniature SENB having a specified length, the specified length in the range of 1 mm to 100 mm; conducting three-point bend testing of the first set of drill cutting specimens to generate a first set of load-displacement measurements; determining, based on the first set of load-displacement measurements, a first fracture toughness for the first depth in the subsurface formation; and generating a fracture toughness log for the subsurface formation including a mapping of fracture toughness versus depth in the formation, the mapping including a mapping of the first fracture toughness to the first depth in the subsurface formation.

In some embodiments, a second subset of the drill cuttings is associated with a second depth in the subsurface formation, and the method further includes: preparing, from the second subset of the drill cuttings, a second set of drill cutting specimens, each drill cutting specimen of the second set of drill cutting specimens including a miniature SENB having the specified length; conducting three-point bend testing of the second set of drill cutting specimens to generate a second set of load-displacement measurements; determining, based on the second set of load-displacement measurements, a second fracture toughness for the second depth in the subsurface formation, where the mapping of the fracture toughness log includes a mapping of the second fracture toughness to the second depth in the subsurface formation.

In some embodiments, each of the drill cutting specimens includes a miniature SENB having a volume in the range of $10^{-8}$ $m^3$ to $10^{-10}$ $m^3$. In some embodiments, each of the drill cutting specimens includes a miniature SENB including a prismatic beam having a length (L) of 8 mm, a width (W) of 3 mm, a thickness (B) of 2.3 mm, and a notch having a notch depth (a) of 1 mm.

In some embodiments, a first subset of drill cutting specimens of the first set of drill cutting specimens includes a bedding plane having a first orientation, and a second subset of drill cutting specimens of the first set of drill cutting specimens includes a bedding plane having a second orientation. In some embodiments, the first orientation is aligned with a lateral axis of the drill cutting specimens such that the bedding plane is parallel to a loading direction of the drill cutting specimens in the three-point bend testing, and the second orientation is aligned with a longitudinal axis of the drill cutting specimens such that the bedding plane is perpendicular to a loading direction of the drill cutting specimens in the three-point bend testing. In some embodiments, a first subset of drill cutting specimens of the first set of drill cutting specimens are treated with an oxidizer based fluid to isolate the effects of organic materials, and a second subset of drill cutting specimens of the first set of drill cutting specimens are not treated with an oxidizer based fluid.

In some embodiments, the fracture toughness log is generated in real-time during the drilling of the wellbore. In some embodiments, the method further includes conducting drilling of the wellbore based on the fracture toughness log. In some embodiments, conducting drilling of the wellbore includes adding lost circulation materials (LCM) to drilling fluid circulated into the wellbore during drilling of the wellbore. In some embodiments, the method further includes conducting a well stimulation operation based on the fracture toughness log. In some embodiments, conducting a well stimulation operation includes conducing a fracturing operation including injecting a substance into the formation to fracture the formation.

Provided in some embodiments is a method that includes: collecting, from drilling fluid circulated in a wellbore during a drilling operation, a drill cutting generated by a drill bit cutting into a subsurface formation; preparing, from the drill cutting, a drill cutting specimen including a miniature SENB having a specified length in the range of 1 mm to 100 mm; conducting a three-point bend testing of the drill cutting specimen to generate load-displacement measurements for the drill cutting specimen; and determining, based on the load-displacement measurements for the drill cutting specimen, a fracture toughness of the subsurface formation.

Figure 1:
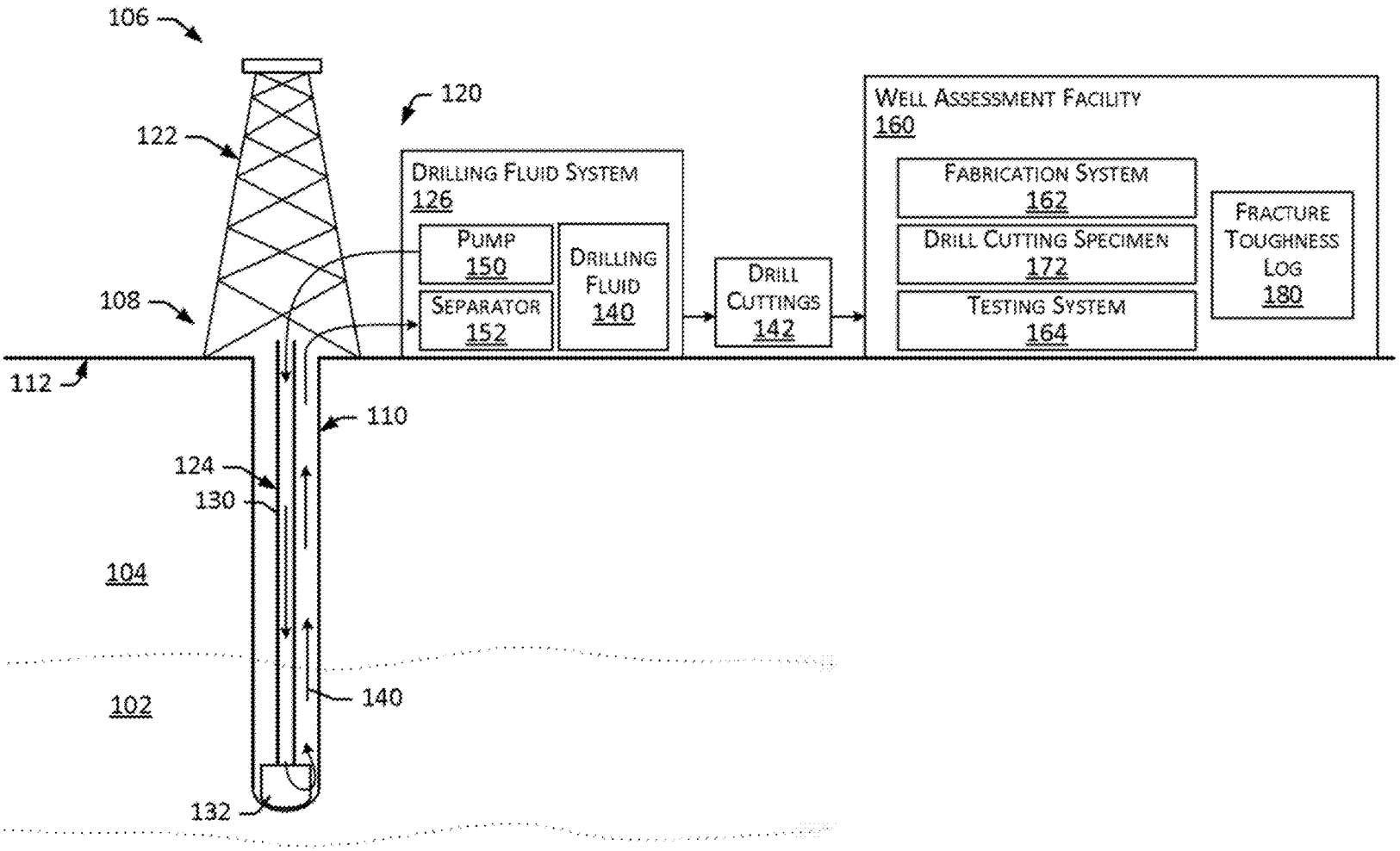
FIG. 1 is a diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed description are not intended to limit the disclosure to the particular form disclosed, but are intended to disclose modifications, equivalents, and alternatives falling within the spirit and scope of the present disclosure as defined by the claims.

DETAILED DESCRIPTION

Described are embodiments of systems and methods for determining fracture toughness of a subsurface geological formation using rock specimens fabricated from drill cuttings extracted during drilling of a wellbore into the formation. The techniques described can be employed, for example, over the course of a drilling operation to generate a log of fracture toughness across a depth interval of interest in the wellbore and the formation. With the combination of drill cuttings that are readily available, and the disclosed shaping and sizing of the specimens that can be formed from drill cuttings to accurately capture the properties of a KRS specimen, the proposed embodiments provide for accurately determining the fracture toughness of a subsurface formation including KRS, using readily available drill cuttings, and with little to no additional cost or delay in operating the well. Thus, the disclosed techniques can be employed, for example, to provide an accurate, real-time fracture toughness log for a well extending into a KRS formation, in a cost effective manner.

In some embodiments, fracture toughness testing is performed using miniature single edge notch beam (SENB) rock specimens prepared directly from drill cuttings representative of a layered geological rock formation. For example, during the drilling of a well, as the drilling fluid is circulated to the surface, drill cuttings (for example, including cuttings and cavings) are transported by the drilling fluid to the surface where they are collected (for example, on a shaker) in a raw unprocessed state. Some of the collected drill cuttings are formed into small specimens (for example, miniature SENB rock specimens), and the small specimens can be tested (for example, via a three-point bend test) to determine fracture toughness of the formation at the depth from which the corresponding drill cuttings were cut. Such a process of collecting drill cuttings, fabricating SENB specimens from the drill cuttings, and testing the SENB specimens can be repeated for different depths to determine fracture toughness values for various depths in the wellbore and the formation, and the determined values for fracture toughness can be used to generate a log of fracture toughness across a depth interval of interest in the wellbore and the formation.

In some embodiments, the testing for a given depth includes the following: (1) obtaining multiple drill cutting samples directly from drilling fluid circulated to the surface during drilling of a wellbore at the given depth in a subsurface formation; (2) fabricating the samples into miniature SENB rock specimens; (3) testing the miniature SENB rock specimens in a three-point bending apparatus to obtain load-displacement measurements; and (5) determining fracture toughness of the formation at the given depth based on the load-displacement measurements.

In some embodiments, some of the specimens are prepared with a bedding plane parallel to the loading direction and some of the specimens are prepared with a bedding plane perpendicular to the loading direction, to obtain fracture toughness measurements for the respective orientations. This can enable a determination of fracture toughness measurements for the respective orientations, at the same location in the formation. In some embodiments, some of the specimens are treated with an oxidizer based fluid to isolate the effects of organic materials, such as kerogen, on the measurements, and some of the samples are untreated. The differences in measurements for the treated specimens and the untreated specimens can be used, for example, to determine the effects of organic material on overall fracture toughness measurements and directional values (or "anisotropy").

In some embodiments, the miniature SENB rock specimens are relatively small, having a volume in the range of about $10^{-8}$ cubic meters ($m^3$) to about $10^{-10}$ $m^3$. Such miniature SENB rock specimens can provide for isolation of the mechanical responses of different phases, especially the OM, from the clay particulates and minerals present in the specimen. In some embodiments, the miniature SENB rock specimens are of the millimeter (mm) scale, having a length in the range of about 1 mm to 100 mm. For example, each of the miniature SENB rock specimens may be a prismatic beam having a length (or "span") of about 8 mm, a width of about 3 mm, and a thickness of about 2.3 mm, and having a notch having a depth of about of about 1 mm. The size and shape of such specimens bridges the gap between the coarse resolution of the large scale (or "core-scale") samples used in some traditional rock mechanics assessment techniques, such as Brazilian tests, and the very fine resolution of the very small scale (or "micro-scale") samples used in some traditional rock mechanics assessment techniques, such as nano-indentation test, while still complying with one or both of American Society for Testing and Materials (ASTM) standards and International Society for Rock Mechanics (ISRM) standards. Applicants have recognized that miniature SENB rock specimens of the described size and scale can isolate the contributions from individual components, especially the OM, to the emergent, systematic fracturing behavior of KRS. That is, miniature SENB rock specimens in the millimeter scale, which can be fabricated from drill cuttings, can overcome issues associated with the coarse resolution of the large scale samples and the very fine resolution of the very small scale samples, thereby providing an accurate and efficient technique for determining fracture toughness of a subsurface formation as a wellbore is being drilled into the subsurface formation. As described, the determination of fracture toughness of a subsurface formation can be used for planning and executing various operations relating to the subsurface formation, such as planning and executing as hydraulic fracturing operations in the subsurface formation, or planning and executing drilling operations, such as LCM management operations, for wells drilled into the subsurface formation.

Although certain embodiments are described in the context of drilling and assessing hydrocarbon wells, formations and reservoirs for the purpose of explanation, embodiments can be employed in various contexts. For example, similar assessments of fracture toughness can be employed for drilling and assessing of water wells, formations and reservoirs.

FIG. 1 is diagram that illustrates a well environment 100 in accordance with one or more embodiments. In the illustrated embodiment, the well environment 100 includes a hydrocarbon reservoir ("reservoir") 102 located in a subsurface formation ("formation") 104, and a well system 106. The well system 106 includes a well 108 defined by a wellbore 110 extending into the formation 104 and the reservoir 102. The wellbore 110 may include a bored hole that extends from the earth's surface ("surface") 112, through the formation 104 and into a target zone or location in the formation 104, such as the reservoir 102. Although the illustrated wellbore 110 includes a vertical wellbore having a substantially vertical trajectory (for example, generally perpendicular to the earth's surface 112), the wellbore 110 can include other trajectories, such as a horizontal wellbore having a trajectory that includes a horizontal segment that extends in a horizontal direction (for example, generally parallel to the earth's surface 112). The wellbore 110 may, for example, be created by a drill bit boring through the formation 104 and into the reservoir 102.

The formation 104 may include a porous or fractured rock formation that resides underground, beneath the earth's surface 112. The reservoir 102 may include a portion of the formation 104 that contains (or is at least determined to or expected to contain) a subsurface pool of hydrocarbons, such as oil and gas. The formation 104 and the reservoir 102 may include different layers of rock having varying characteristics, such as varying degrees of permeability, porosity, resistivity and fracture toughness. In the case of the well 108 being operated as a production well, the wellbore 110 may facilitate the extraction (or "production") of hydrocarbons from the reservoir 102. In the case of the well 108 being operated as an injection well, the wellbore 110 may facilitate the injection of fluids, such as water, into the reservoir 102. In the case of the well 108 being operated as a monitoring well, the wellbore 110 may facilitate the monitoring of various characteristics of the reservoir 102, such reservoir pressure, for example, using sensors and other monitoring devices disposed in the wellbore 110 (or "downhole").

The well system 106 may include a drilling system 120 that provides for drilling the wellbore 110. The drilling system 120 can include a drilling rig 122, a drill string 124 and a drilling fluid system 126. The drill string 124 may include drill pipe 130 and a drill bit 132. As illustrated, the drill pipe 130 may extend from a surface location (for example, at or above the earth's surface 112) into the wellbore 110. The drill bit 132 or other tools may be coupled to a distal (or "downhole") end of the drill pipe 130 that extends into the wellbore 110. During a drilling operation, the drilling rig 122 may provide a motive force to rotate and push the drill string 124 into the wellbore 110, or otherwise support the drill string 124, to facilitate the drill bit 132 cutting through the formation 104 to form the wellbore 110. During the drilling operation, the drilling fluid system 126 may circulate drilling fluid 140, such as drilling mud, in the wellbore 110 to, for example, provide hydrostatic pressure to prevent formation fluids from flowing into the wellbore 110, to cool and clean the drill bit 132, and to carry drill cuttings 142 away from the drill bit 132 and out of the wellbore 110.

The drill cuttings 142 can include cuttings and cavings generated as the drill bit 132 cuts through the formation 104. Cuttings may refer to broken pieces of solid material, such as formation rock, physically cut from the formation 104 by contact of the drill bit 132 with the formation 104. Cavings may refer to pieces of solid material, such as formation rock, that fall into (or "cave" into) the drilling fluid 140 at or near the drill bit 132, but are not necessarily the direct result of the drill bit 132 cutting the formation 104. The cavings can include, for example, loose pieces of formation rock that fall into the wellbore 110 and the drilling fluid 140 due to vibrations associated with the drill bit 132 contacting the formation 104.

The drilling fluid system 126 may include a pump 150 and a separator 152. The pump 150 can be operated to circulate the drilling fluid 140 through the wellbore 110 during drilling operations (as illustrated by the directional arrows in the wellbore 110 of FIG. 1). For example, the pump 150 may be operated to pump "clean" drilling fluid 140 into a proximal (or "uphole") end of the drill pipe 130 located at the surface 112. The pumped clean drilling fluid 140 may flow down, through the length of the drill pipe 130 to a distal (or "downhole") end of the drill pipe 130 at or near the drill bit 132 (for example, located at the bottom of the wellbore 110) where the drill bit 132 is cutting into the rock of the formation 104. The clean drilling fluid 140 may flow into and through the drill bit 132 and into an annular region of the wellbore 110 located between the drill string 124 and the wall of the wellbore 110 (for example, between an outer diameter of the drill pipe 130 and the drill bit 132 and the wall of the wellbore 110). As the drilling fluid 140 circulates around the drill bit 132 and into the annular region of the wellbore 110, the drilling fluid 140 may capture drill cuttings 142 generated as a result of the drill bit 132 cutting into the formation 104. The drilling fluid 140 that includes the drill cuttings 142 may be referred to as "dirty" drilling fluid 140. Due to the hydrostatic force of the clean drilling fluid 140 being pumped into the wellbore 110 via the drill string 124, the dirty drilling fluid 140 may be pushed up, through the annular region of the well 108, to the surface 112, where it exits the wellbore 110 and is routed to the separator 152 by, for example, a drilling fluid return line (or a "mud return line").

The separator 152 may filter the dirty drilling fluid 140 to separate (or "extract") the drill cuttings 142 and other debris from the drilling fluid 140. The separator 152 may include, for example, a shale shaker that filters the drilling fluid 140 to remove the drill cuttings 142 from the drilling fluid 140. The filtered drilling fluid 140 (now "cleaned" by the separator 152) may be returned to a drilling fluid reservoir (for example, a mud pit) where, for example, it is mixed with other clean drilling fluid. The mix of clean drilling fluid can be circulated into the wellbore by the pump 150 in a similar manner to provide a continuous circulation of drilling fluid 140 to support the ongoing drilling operation.

The drill cuttings 142 that are extracted from drilling fluid 140 may be routed away from the separator 152 (for example, on a conveyor) for further inspection or disposal (for example, in a reserve pit). In some embodiments, some of the drill cuttings 142 can be routed to a well assessment facility 160 for testing to determine characteristics of the drill cuttings 142 and, in turn, characteristics of the well 108 and the formation 104. The well assessment facility 160 can include an "on-site" facility located at the drilling site (for example, within about 10,000 m of the well 108), or an off-site facility located remote from the drilling site (for example, more than about 10,000 m from the well 108). An on-site assessment facility 160 may facilitate the assessment of drill cuttings 142 almost immediately after they are extracted from the well 108 and the drilling fluid 140, without the delay associated with having to transport the drill cuttings 142 to a remote facility.

The well assessment facility 160 can include a fabrication system 162 and a testing system 164. The fabrication system 162 can include tools (for example, cutting and polishing devices) for fabricating and otherwise preparing drill cutting specimens 172 from samples of the drill cuttings 142 (or "drill cutting samples"), for testing by the testing system 164. The testing system 164 can include a testing apparatus, such as a three-point bend testing apparatus, for testing drill cutting specimens 172. Each drill sample of the drill cuttings 142 may include a piece of the drill cuttings 142 that is of sufficient size and shape to be formed into one or more drill cutting specimens 172 of a required size and shape for testing by the testing system 164. Each of the drill cutting specimens 172 may include, for example, a miniature SENB shaped rock specimen. Each of the SENB shaped drill cutting specimens 172 may be subjected to a three-point bend test by the testing system 164 to generate fracture toughness measurements (for example, load versus displacement measurements) that can be used to determine the fracture toughness of the drill cutting specimen 172. The fracture toughness of the drill cutting specimen 172 can be used, in turn, to determine a fracture toughness of the formation 104 at the depth from which the corresponding drill cutting 142 was removed from the wellbore 110 (for example, at the depth from which the drill cutting 142 from which the drill cutting specimen 172 was prepared, was removed from the wellbore 110). As described, fracture toughness can be determined for different depths in the formation 104, and the determined fracture toughness values can be combined to generate a fracture toughness log 180 for the well 108. The fracture toughness log 180 may include a mapping of fracture toughness of the formation 104 versus depth in the formation 104 or the wellbore 110.

Figure 2:
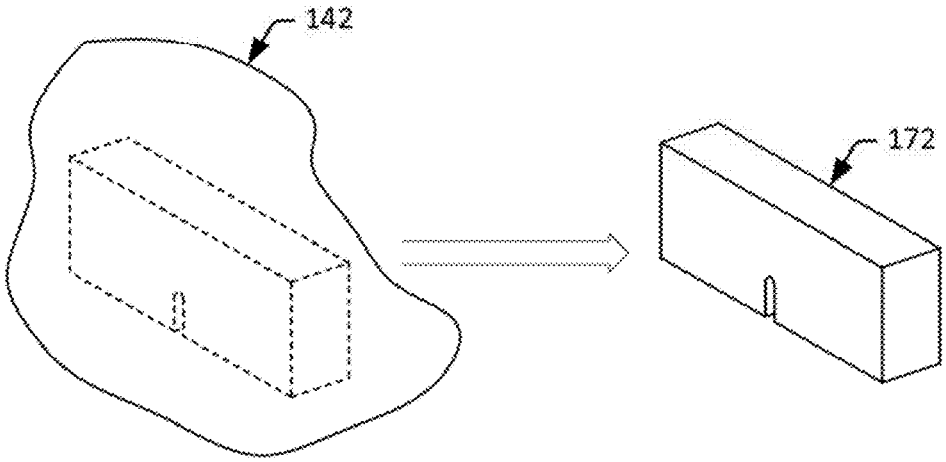
FIG. 2 is a diagram that illustrates preparation of a drill cutting specimen from a drill cutting in accordance with one or more embodiments.
Figure 3A:
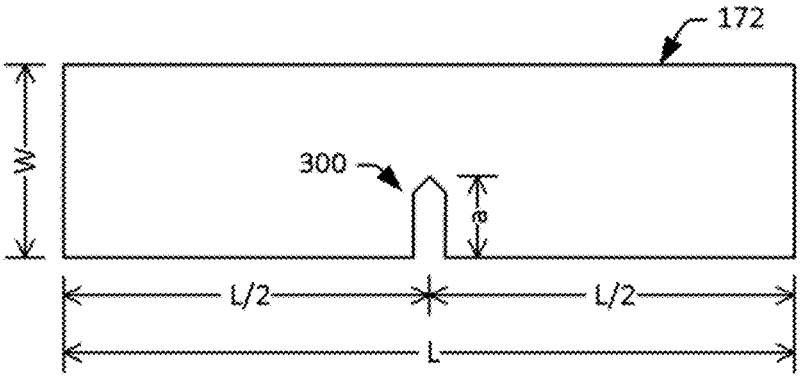
FIGS. 3A and 3B are diagrams that illustrate front and side views, respectively, of a drill cutting specimen in accordance with one or more embodiments.
Figure 3B:
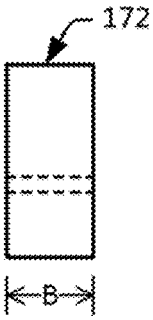

FIG. 2 is a diagram that illustrates preparation of a drill cutting specimen 172 from a sample drill cutting 142 in accordance with one or more embodiments. As illustrated, a sample drill cutting 142 may need to be as large as or larger than the specified dimensions of the drill cutting specimen 172 to enable the drill cutting specimen 172 to be cut from the sample drill cutting 142. For example, the sample drill cutting 142 may need to larger than a specified length (L), width (W) and thickness (B) of the drill cutting specimen 172 to be prepared from the sample drill cutting 142. FIGS. 3A and 3B illustrate front and side views, respectively, of a drill cutting specimen 172 in accordance with one or more embodiments. As illustrated, the drill cutting specimen 172 may be shaped to form a SENB beam having a length (L), a width (W) and thickness (B), and having a single notch 300 extending into the drill cutting specimen 172. In some embodiments, the dimensions of the drill cutting specimen 172 may conform to one or more testing standards, such as ASTM E 399-12. According to ASTM 399-12, for example, the length (L) may be about 3 to 5 times the width (W), the thickness (B) may be ½ of the width (W), and the notch depth (a) may be about 20% to 30% of the width (W). In some embodiments, the drill cutting specimen 172 is a relatively small (or "miniature") SENB rock specimen, having a volume in the range of about $10^{-8}$ $m^3$ to about $10^{-10}$ $m^3$. In some embodiments, the drill cutting specimen 172 is a miniature SENB rock specimen of the millimeter scale, having a length (L) in the range of about 1 mm to 100 mm. For example, the drill cutting specimen 172 may be a prismatic beam of millimeter scale, having a length (L) of about 8 mm, a width (W) of about 3 mm, a thickness (B) of about 2.3 mm, and a notch depth (a) of about of about 1 mm. In such an embodiment, selection of the corresponding sample drill cutting 142 can include selecting a drill cutting 142 having at least a portion that is equal to or larger (for example, at least 10% larger) than 8 mm×3 mm×2.3 mm.

A drill cutting specimen 172 may be prepared with a bedding plane in a particular orientation. In some embodiments, a drill cutting specimen 172 may be prepared with a bedding plane that is perpendicular to or parallel to a loading direction. For example, where a load is applied parallel with the notch 300 during testing, the drill cutting specimen 172 may be prepared with a bedding plane that is perpendicular to or parallel to the notch 300. FIG. 4A is a diagram that illustrates a drill cutting specimen 172 having a bedding plane 400 perpendicular to the notch 300 and a direction of a test loading (P). FIG. 4B is a diagram that illustrates a drill cutting specimen 172 having a bedding plane 400 parallel to the notch 300 and a direction of a test loading (P). The drill cutting specimen 172 may have a lateral axis 402 running across the width of the drill cutting specimen 172, and a longitudinal axis 404 running across the length of the drill cutting specimen 172, perpendicular to the lateral axis 402. The notch 300 and the direction of a test loading (P) may be parallel to the lateral axis 402 and perpendicular to the longitudinal axis 404. In an embodiment in which the drill cutting specimen 172 has a bedding plane 400 perpendicular to the notch 300 and the direction of a test loading (P), the bedding plane 400 may be generally parallel to the longitudinal axis 404 (for example, oriented +/−10 degrees from the longitudinal axis 404). In an embodiment in which the drill cutting specimen 172 has a bedding plane 400 parallel to the notch 300 and the direction of a test loading (P), the bedding plane 400 may be generally parallel to the lateral axis 402 (for example, oriented +/−10 degrees from the lateral axis 402).

Figure 4D:
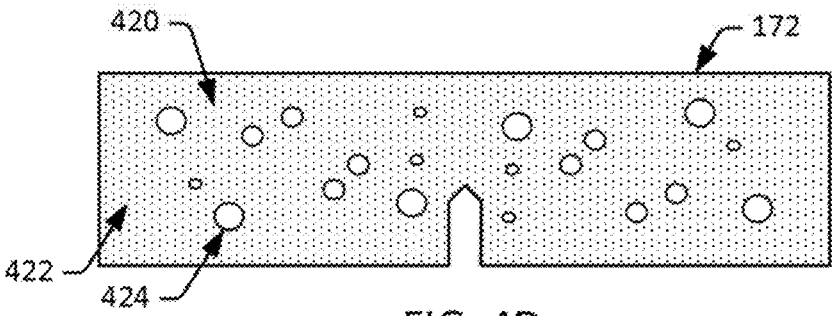
FIG. 4D is a diagram that illustrates a speckled drill cutting specimen in accordance with one or more embodiments.
Figure 4B:
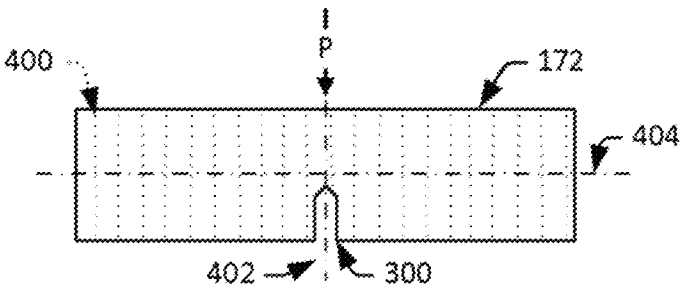
FIGS. 4A and 4B are diagrams that illustrate drill cutting specimens having different bedding plane orientations in accordance with one or more embodiments.
Figure 4A:
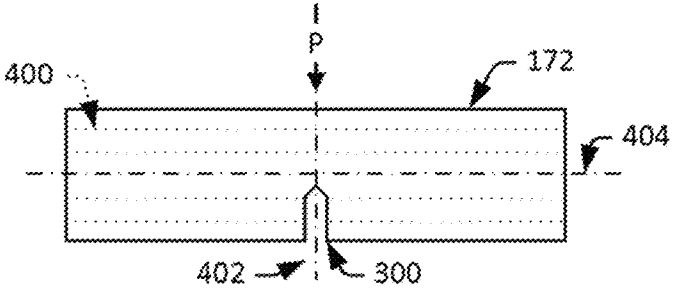
Figure 4C:
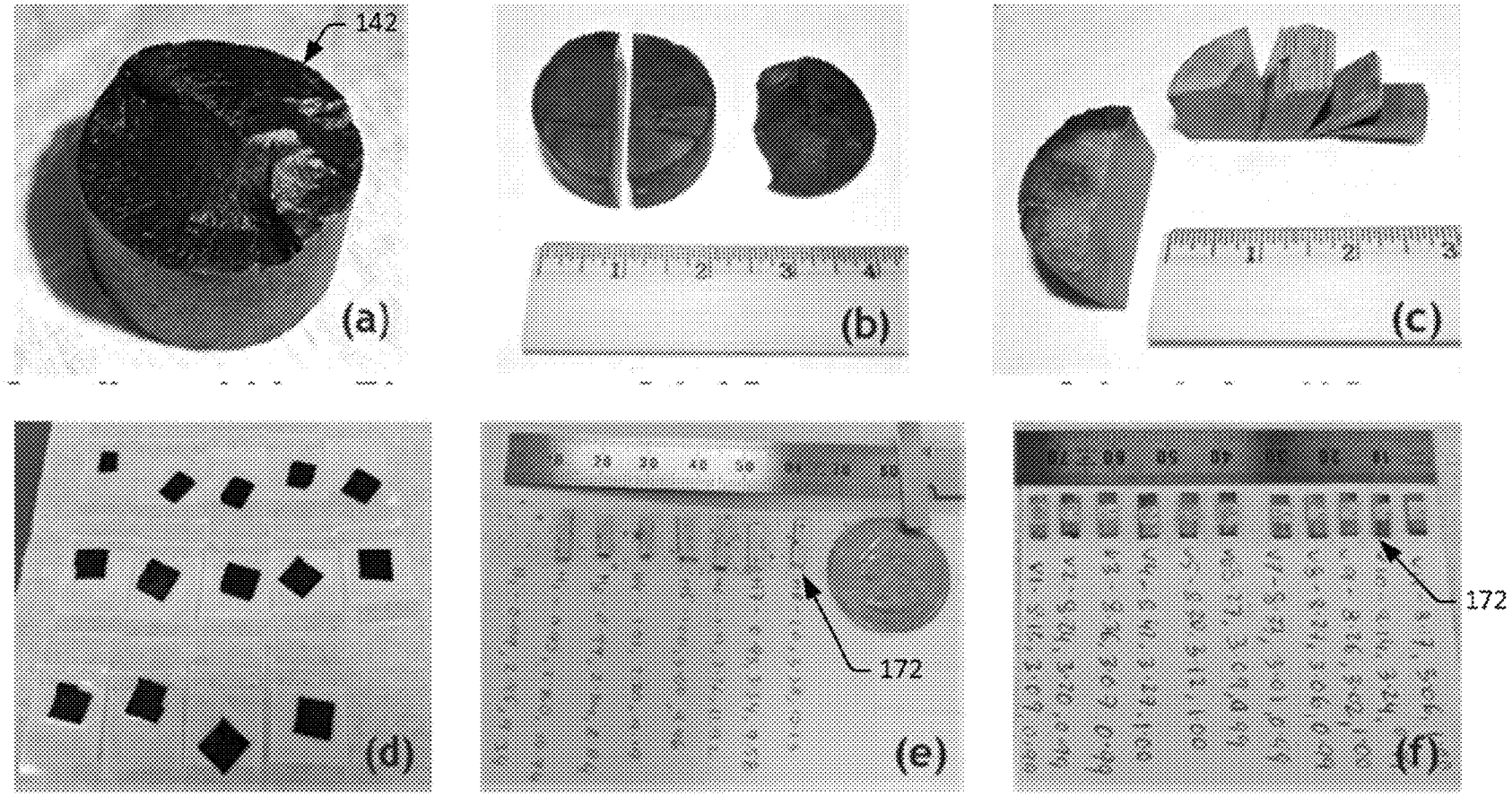
FIG. 4C includes images that illustrate an example technique for fabrication of drill cutting specimens in accordance with one or more embodiments.

FIG. 4C includes images that illustrate an example technique for fabrication of drill cutting specimens in accordance with one or more embodiments. As illustrated, multiple drill cutting specimens 172 having different bedding plane orientations can be fabricated from a sample drill cutting 142, such as a kerogen-rich shale sample. For example, in a first step, a preserved kerogen-rich shale sample (a preserved kerogen-rich shale sample drill cutting 142) is taken with bedding plane perpendicular to the sample axis (see 1*a* of FIG. 4C which illustrates a preserved kerogen rich shale sample having a diameter of about 2 inches (or 51 mm)). The sample is then cut in half, forming two pieces of the sample (see 1*b* of FIG. 4C which illustrates the preserved kerogen rich shale sample cut into two pieces), and each piece of the sample is sliced into 1 mm thick plates (see 1*c*-1*d* of FIG. 4C which illustrate the two pieces of preserved kerogen rich shale sample sliced into 1 mm thick plates). The resulting 1 mm thick rectangular shaped plates are used as reference plates and are preserved in oil. From these reference plates, smaller prismatic beams with spans (L) in the range of about 3 mm to 10 mm, widths (W) in the range of about 2 mm to 4 mm and thicknesses (B) of about 1 mm are cut off; some with beam spans parallel to the bedding planes (see 1*e* of FIG. 4C which illustrates plates having a bedding plane positioned to be perpendicular to the notch to be formed and the direction of loading to be applied during testing) and some with beam spans perpendicular to the bedding planes (see 1*f* of FIG. 4C which illustrates plates having a bedding plane positioned to be parallel to the notch to be formed and the direction of loading to be applied during testing). A diamond cut-off wheel of thickness of about 0.15 mm, for example, can be used to cut a notch into each of the beams, creating a rectangular profile on the macro scale. After cutting, the resulting notch is about 0.2 mm wide and has a length (a) of about 20% to 30% of the specimen width (W) (for example, where width (W) is 3 mm, the notch depth (a) may be in the range of about 0.6 mm to 0.9 mm). The resulting specimens may each be SENB shaped drill cutting specimens 172 that can be associated with the formation depth from which the sample drill cutting 142 (for example, the kerogen-rich shale sample of 1*a* of FIG. 4C) was extracted from. Although certain sizes and geometries of drill cutting specimens 172 are described for the purpose of illustration, the drill cutting specimens 172 may be formed of other suitable sizes and geometries. For example, drill cutting specimens 172 may include SENBs having a span of about 30 mm, a width of about 10 mm, a thickness of about 3 mm, and total volume of about 900 $mm^3$ (for example, having an aspect ratio of about 3.0, defined by span/width); SENBs having a span of about 20 mm, a width of about 3 mm, a thickness of about 2 mm, and total volume of about 120 $mm^3$ (for example, having an aspect ratio of about 6.66); SENBs having a span of about 8 mm, a width of about 4 mm, a thickness of about 2.3 mm, and total volume of about 73.6 $mm^3$ (for example, having an aspect ratio of about 2.0); SENBs having a span of about 4 mm, a width of about 2 mm, a thickness of about 1 mm, and total volume of about 8 $mm^3$ (for example, having an aspect ratio of about 2.0); or SENBs having a span of about 2 mm, a width of about 1 mm, a thickness of about 0.5 mm, and total volume of about 1 $mm^3$ (for example, having an aspect ratio of about 2.0).

In some embodiments, the specimens are "speckled" to create contrast in the images of the specimen acquired during testing and to generate reference points that can be located in the images as coordinates for use in measuring the distance between the points and relative movement between the points. For example, the specimens may be painted with liquid chalk powder to provide a contrasting background on a face of the specimen, and then spray painted with a contrasting color to create random dots on the face that form reference points on the background. The chalk powder can provide improved contrast in the resulting images, and the dots from the spray paint can provide individual reference points that can be located in the images of the specimen acquired (for example, located via image processing) during testing, and tracked (for example, tracked via image processing) between the different images to determine the distance and relative movements between the points during testing. These distances and movements can, in turn, be used to determine displacement of the underlying portions of the specimen under the loading conditions of the testing. During testing, the image pixels can be calibrated with respect to the sample geometry using the reference points, which can be expressed in the mm scale. Using such an optical tracking method, crack length or crack mouth opening displacement (CMOD) may be measured within about 6 micrometers (μm) of accuracy.

FIG. 4D is a diagram that illustrates a chalked and painted (or "speckled") drill cutting specimen 172 in accordance with one or more embodiments. In the illustrated embodiment, a face 420 of the drill cutting specimen 172 that faces a camera of a drill cutting specimen test apparatus during testing, is coated with chalk of a first color to form a layer of chalk 422 on the face 420. A mist of paint of a second color (for example, a contrasting color that is different from the first color) is then sprayed on top of the layer of chalk 422, to generate paint speckles 424 on the face 420. The paint speckles 424 can provide individual reference points that can be located in the images of the drill cutting specimen 172 acquired during testing, and be tracked between the different images to determine the distance and relative movements between the points during testing. These distances and movements can, in turn, be used to determine displacement of the underlying portions of the drill cutting specimen 172 under the loading conditions of the testing. The coloring agents (for example, the layer of chalk 422 and the paint speckles 424) may be thin and granular in nature such that the coloring agents do not create bonding strength that can arrest or otherwise inhibit crack initiation and propagation through the drill cutting specimen 172 during testing.

Figure 5A:
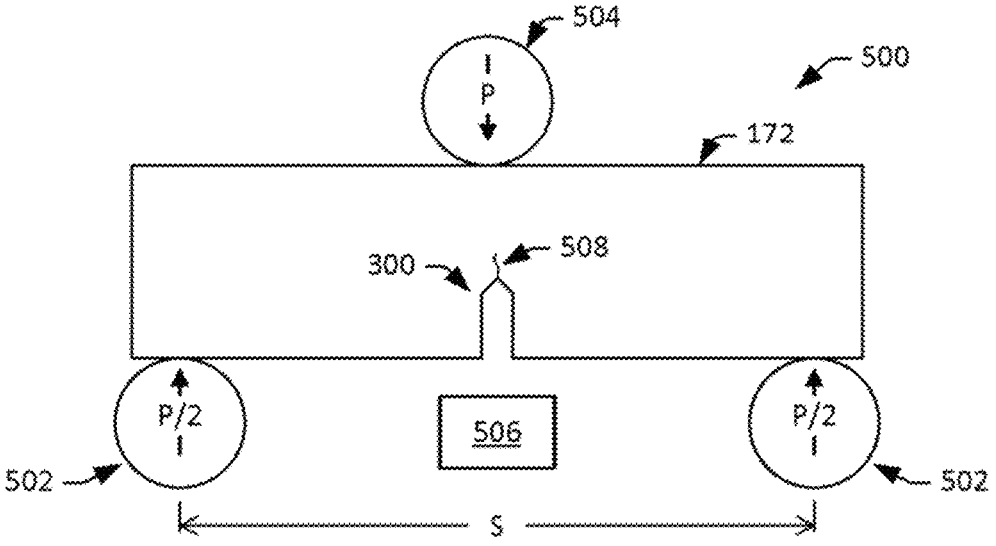
FIG. 5A is a diagram that illustrates a drill cutting specimen test apparatus in accordance with one or more embodiments.

FIG. 5 is a diagram that illustrates a drill cutting specimen test apparatus 500 in accordance with one or more embodiments. The apparatus 500 includes two supports 502, a loading ram 504, and a measurement system 506. The two supports 502 are located a given support span (S) from one another and the loading ram 504 is centered between the two supports 502 and is configured to align with the notch 300 during a testing operations. The support span (S) may be about 3 to 5 times the width (W) of the drill cutting specimen 172 being tested (for example, S=4*W). For example, for a specimen of a width of 3 mm, the support span (S) may be in the range of about 7 mm to 12 mm. In some embodiments, the span length is in the range of about 2.5 to 3.0 times the width. During a testing operation, the loading ram 504 may be operated to press against a first side of the drill cutting specimen 172 (the side opposite the notch 300) to generate a loading force (P), and the two supports 502 may each provide an opposing supportive force (P/2) to a second side of the drill cutting specimen 172. During testing, the loading force (P) can be continually increased, and propagation of any crack 508 extending from the notch can be measured by the measurement system 506. The measurement system 506 may include, for example, a high-speed and high-definition camera and image processing software that is capable of visually monitoring and measuring the propagation of the crack 508. During testing, the camera can be focused on the SENB drill cutting specimen 172 (for example, between the point of loading (P) and the notch 300) and record images of that portion of the drill cutting specimen 172 as the drill cutting specimen 172 deforms with initiation and propagation of the crack 508. The camera and software may be synchronized to the loading ram 504 such that it obtains the instantaneous value of the loading force (P) over the duration of the test (for example, synchronizing the mechanical loading data (force, loading anvil displacement, and time) with each of the "fracture" images of the specimen acquired to enable measuring of the crack length, crack mouth opening displacement (CMOD)), and can provide a log of the crack propagation (for example, a measured length of the crack 508) versus the corresponding loading force (P) over the duration of the test. Such a log may include a load-displacement plot. FIG. 6A is a diagram that illustrates example load-displacement plots for two different drill cutting specimens 172 in accordance with one or more embodiments. The first load-displacement plot 602 illustrates an example load-displacement plot for a "ShaleOil-SO1" drill cutting specimen 172, and the second load-displacement plot 604 illustrates an example load-displacement plot for a "ShaleBituminous-SO2" drill cutting specimen 172.

With regard to the mechanical loading frame of the drill cutting specimen test apparatus 500, the loading frame and fixture may be configured to maintain stable crack growth in the specimen being tested. In some embodiments, the drill cutting specimen test apparatus 500 is capable of measuring in the range of about 1 (Newton) N to 5 N with about 0.5% accuracy In some embodiments, the three-point bending fixture has a span length (S) in the range of about 1 mm to 100 mm. In some embodiments, a displacement controlled loading rate ranges between 1 μm/s to 50 μm/s, depending upon size and geometry of the specimen 172 being tested. In some embodiments, the applied loading rate is limited to a range not leading to unstable crack growth.

With regard to the measurement system 506, a camera of the measurement system 506 can include a high-speed camera having a video capture rate of about 1,000-50,000 frames per second (FPS) or greater, depending upon sample geometry and applied loading rate, and a resolution of about 300×500 pixels or higher (for example, for 2 mm×3 mm specimen area to be imaged) to provide sufficient accuracy to identify crack tip, profile, location, length, and crack opening displacement. Digital image correlation (DIC) may be employed using the acquired images to compute deformation and strain filed of the drill cutting specimen 172. For example, as the drill cutting specimen 172 begins to deform during Mode-I fracture, a series of images of the speckled drill cutting specimen 172 can be captured using the high-speed camera, and the DIC technique can be implemented to register the images and track the changes of coordinates in the drill cutting specimen 172 (for example, marked by the paint speckles 424) as the crack (for example, crack 508) propagates to calculate the deformation ($U_x$, $U_y$) and strain ($\varepsilon_x$, $\varepsilon_y$) fields. These can be input variables for modeling the damaged plastic zone, fracture processing zone driven by the heterogeneity and anisotropy of the drill cutting specimen 172, as in kerogen-rich shale.

Figure 7B:
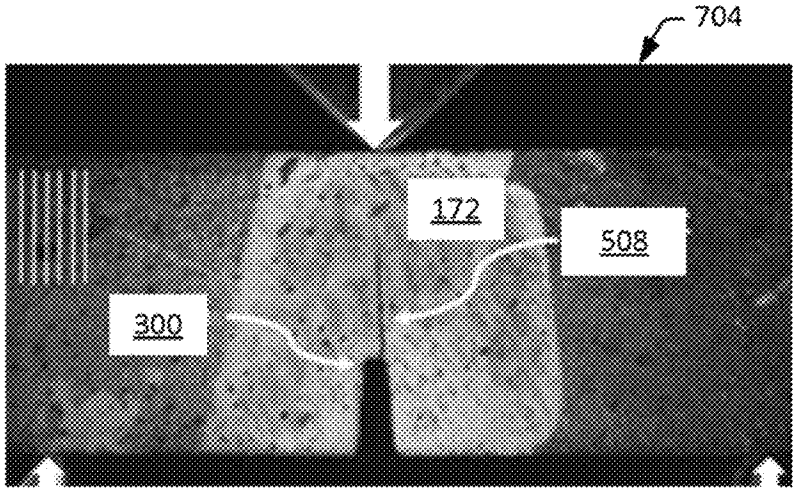
FIGS. 7A and 7B include example images acquired during testing of drill cutting specimens in accordance with one or more embodiments.
Figure 7A:
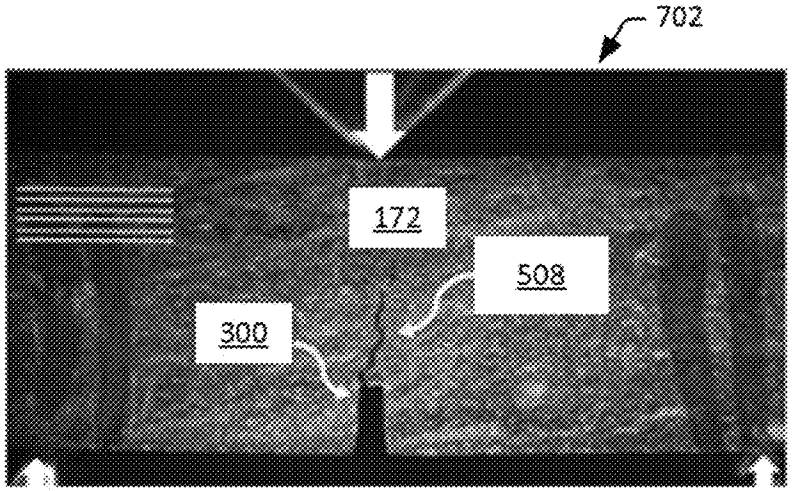
Figure 6A:
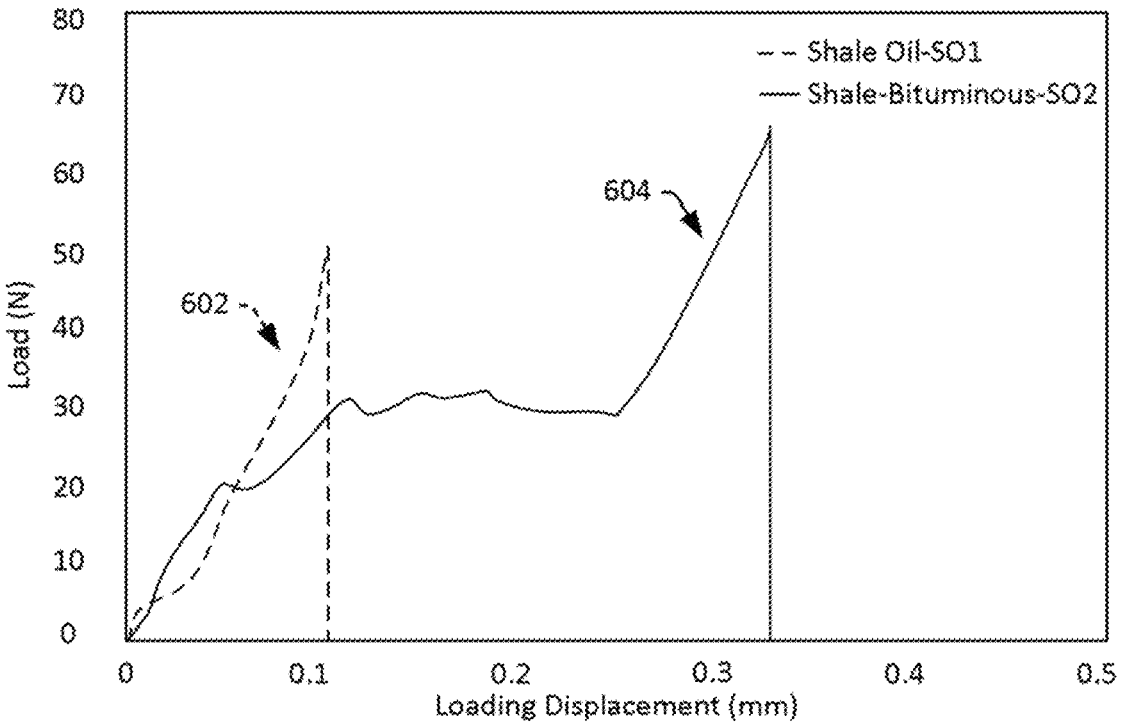
FIGS. 6A-6E are diagrams that illustrate example load-displacement plots for drill cutting specimens in accordance with one or more embodiments.

FIGS. 7A and 7B include example images acquired during testing of drill cutting specimens (with spans of 8 mm and widths of 3 mm) after loading in accordance with one or more embodiments. FIG. 7A includes a first image 702 illustrating a first SENB drill cutting specimen 172 having a bedding plane perpendicular to the notch 300 and the direction of loading, and a tortuous crack 508 resulting from the loading. FIG. 7B includes a second image 704 illustrating a second SENB drill cutting specimen 172 having a bedding plane parallel to the notch 300 and the direction of loading, and a straight crack 508 resulting from the loading. Notably, the contrast of the speckles is readily apparent in the second image 704 of FIG. 7B. As can be seen in the comparison of the images of FIGS. 7A and 7B, the bedding plane orientation can have a significant effect on the fractured surface of kerogen rich shale. As illustrated in FIG. 7A, the perpendicular bedding plane orientation resulted in a tortuous crack 508, and, as illustrated in FIG. 7B, the parallel bedding plane orientation resulted in a straight crack 508. The work required to initiate and propagate a crack through formation rock can be significantly different for different bedding plane orientations, as illustrated in FIG. 6F and the corresponding load-displacement plots of FIGS. 6B and 6E. In some instances it can take about 3 to 5 times more work energy to initiate and propagate a crack across a perpendicular bedding plane (oriented at 90°) than along a parallel bedding plane (oriented at 0°). The amount of work energy may vary with bedding plane orientations between 0° and 90°. The fracture toughness of formation rock can also be influenced by bedding plane orientation, as illustrated in FIGS. 6G and 6H. Heterogeneity and placement of minerals and organic matter in the crack tip and crack path can also have a significant impact on the energy requirement and overall crack profile. The techniques described here, including the forming and testing of SENB specimens, may be capable of detecting such phenomena, as is evident from the kinks present in FIGS. 6C and 6D. This can be of great importance, especially for use in designing and implementing perforation direction to minimize energy cost while creating the maximum fracture during hydraulic fracturing operation. For example, an optimum hydraulic fracturing design that minimizes energy cost and creates maximum fracturing may be generated based on the rock characteristics derived using the described embodiments, and the hydraulic fracturing operation may be undertaken to fracture the formation rock, to enhance recovery of hydrocarbons from the formation.

Figure 5B:
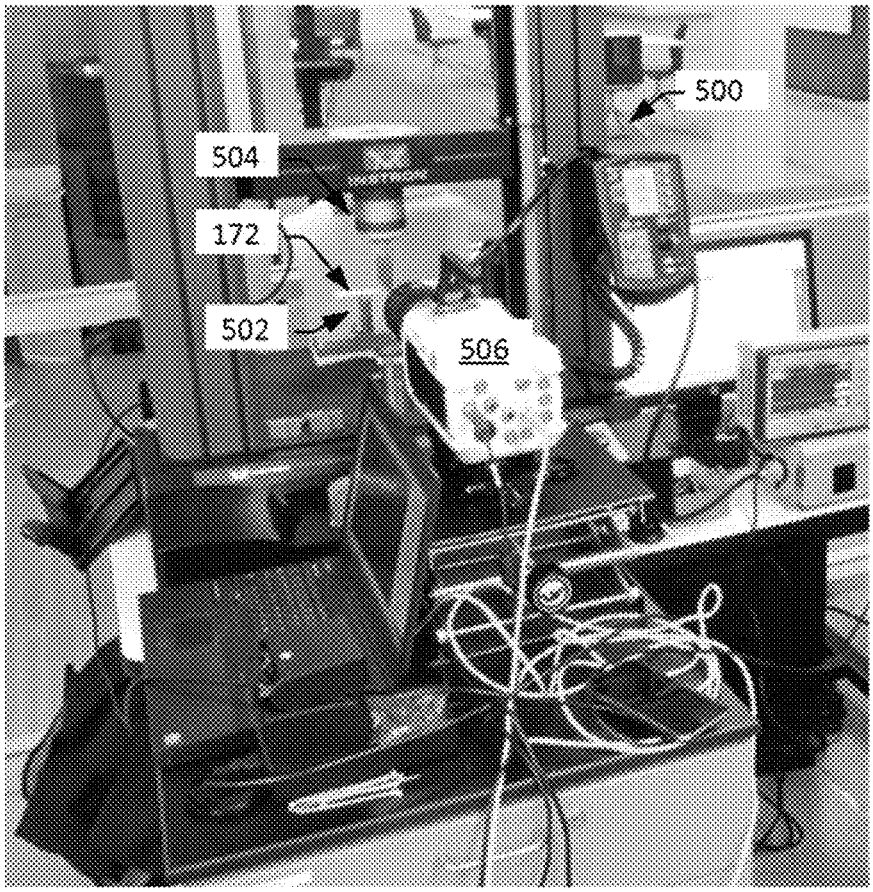
FIG. 5B is an image that depicts an example drill cutting specimen test apparatus in accordance with one or more embodiments.

FIG. 5B is an image that depicts an example drill cutting specimen test apparatus 500 in accordance with one or more embodiments. In the illustrated embodiment, the measurement system 506 includes a high speed camera focused on a SENB drill cutting specimen 172.

Figure 6B:
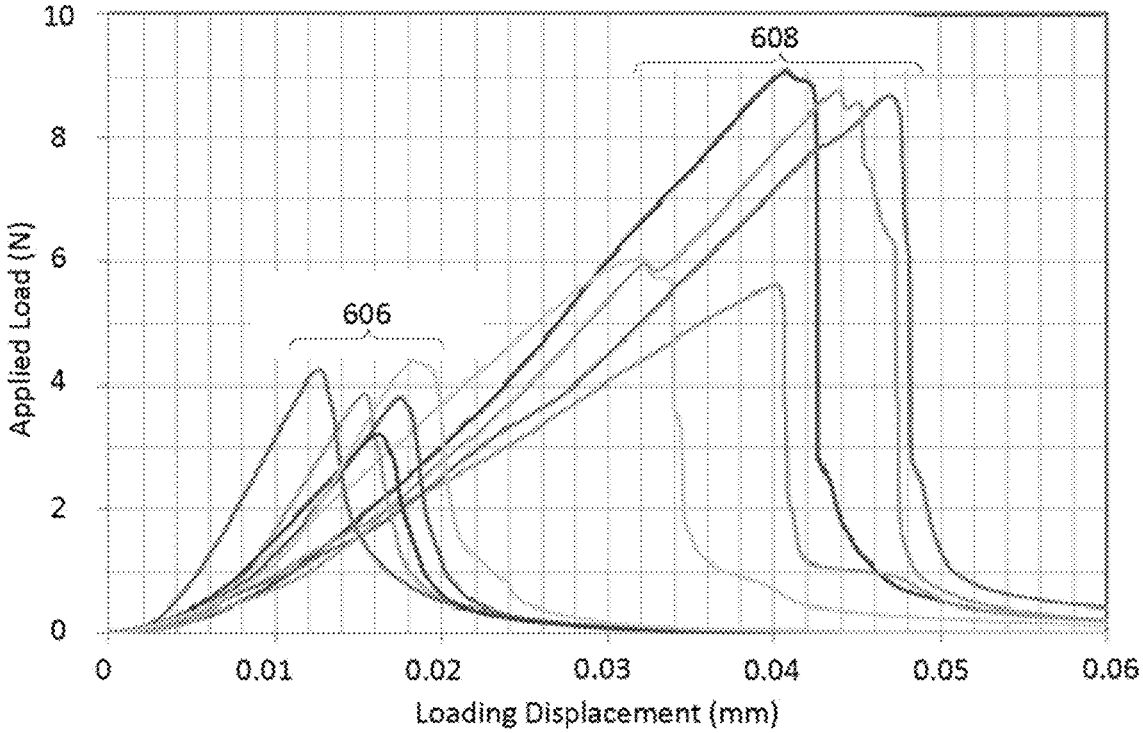
Figure 6C:
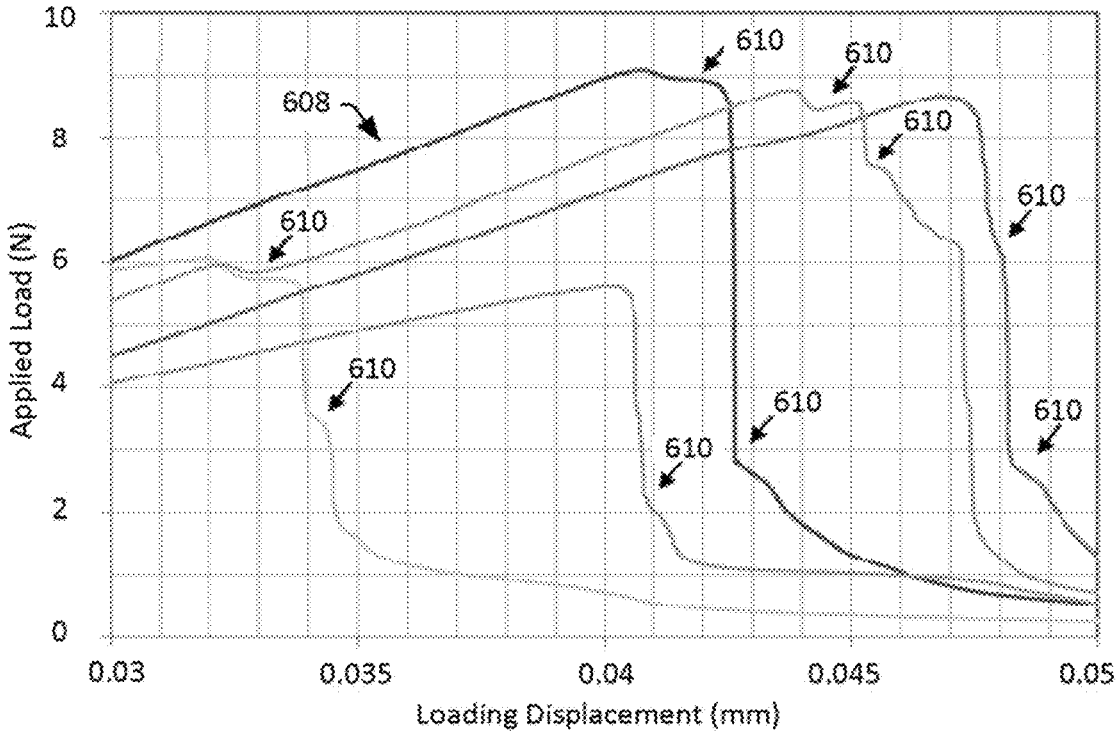
Figure 6D:
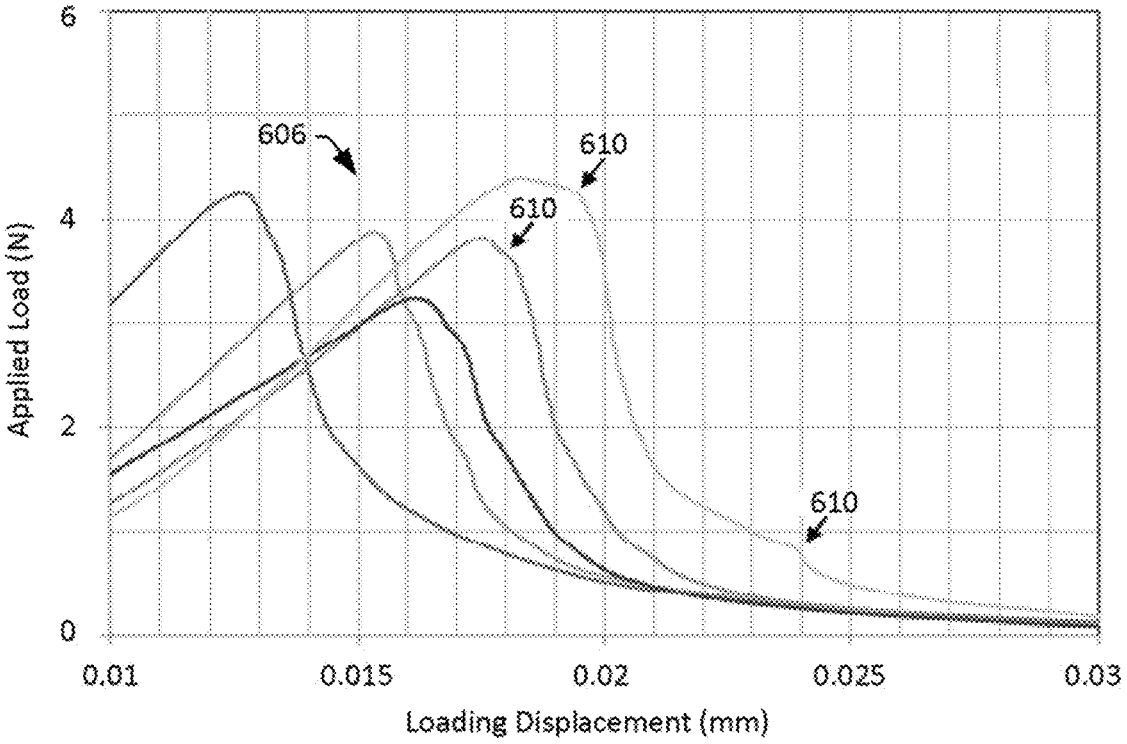
Figure 6E:
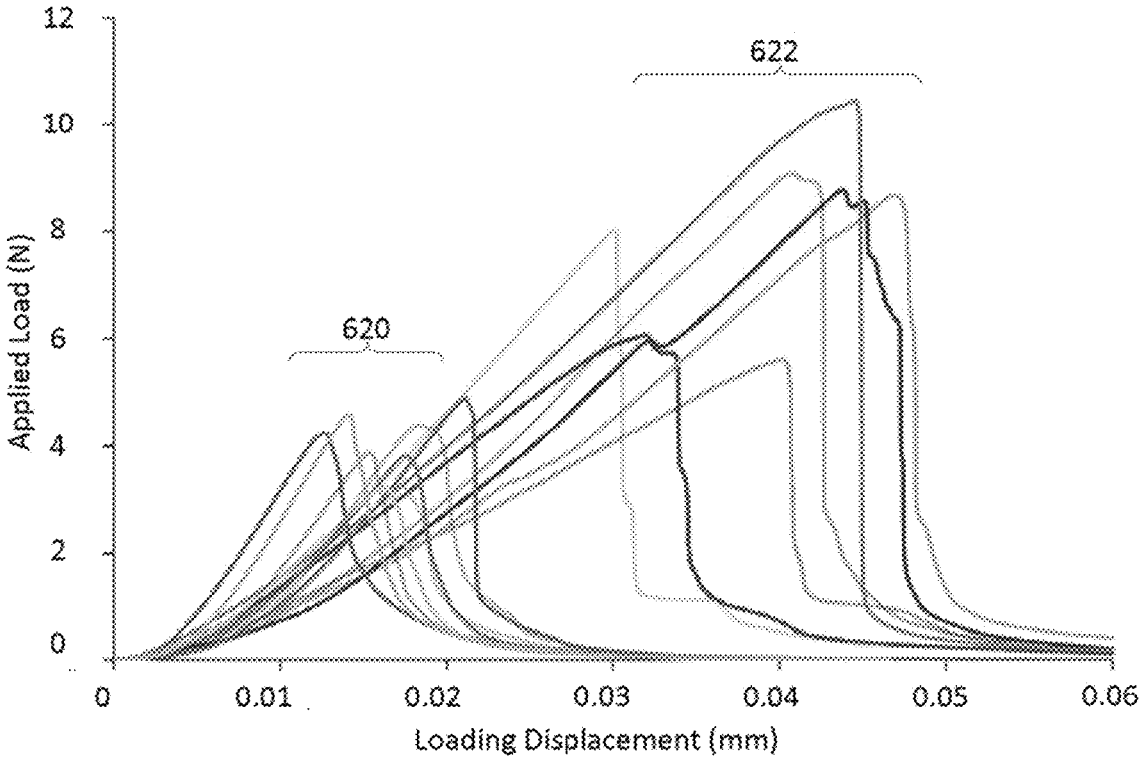
Figure 6F:
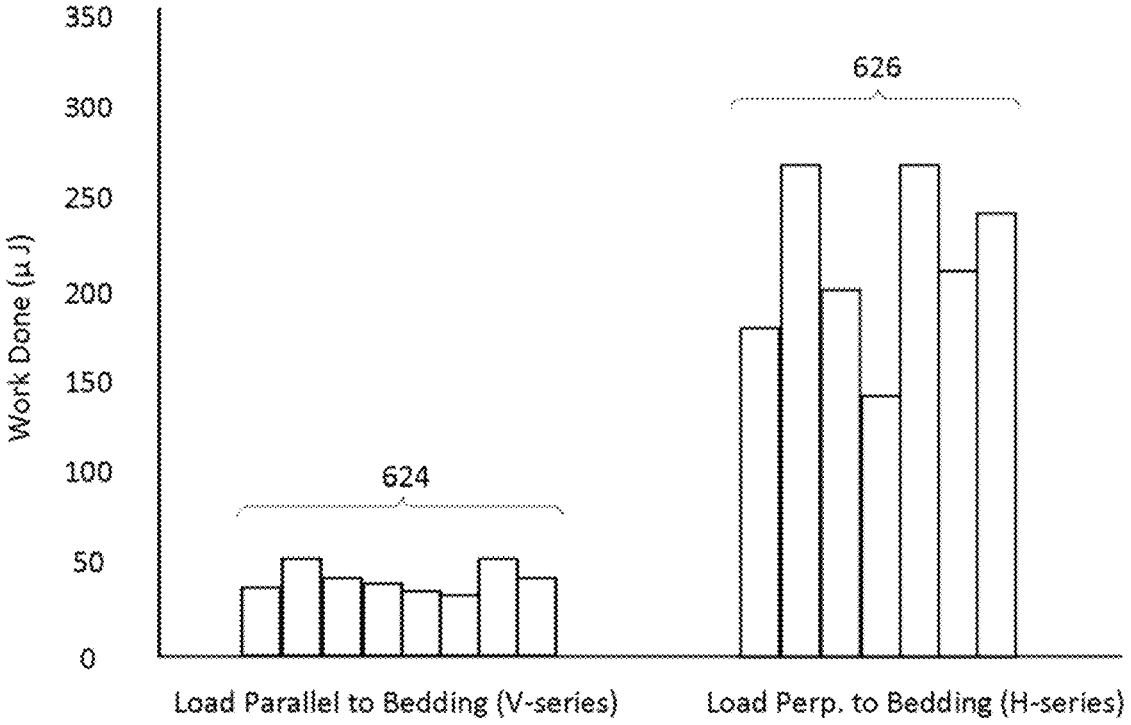
FIG. 6F is a diagram that illustrates work done corresponding to the load-displacement plots of FIG. 6C in accordance with one or more embodiments.
Figure 6G:
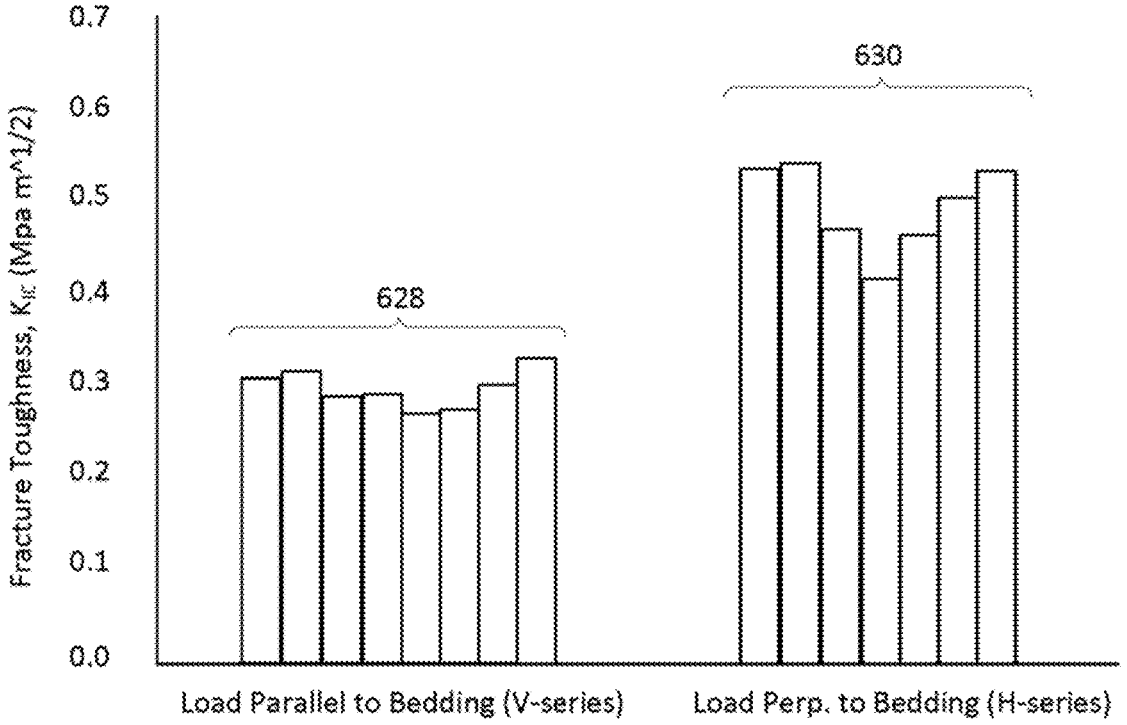
FIGS. 6G and 6H are diagrams that illustrate fracture toughness determined for samples corresponding to the load-displacement plots of FIG. 6C in accordance with one or more embodiments.
Figure 6H:
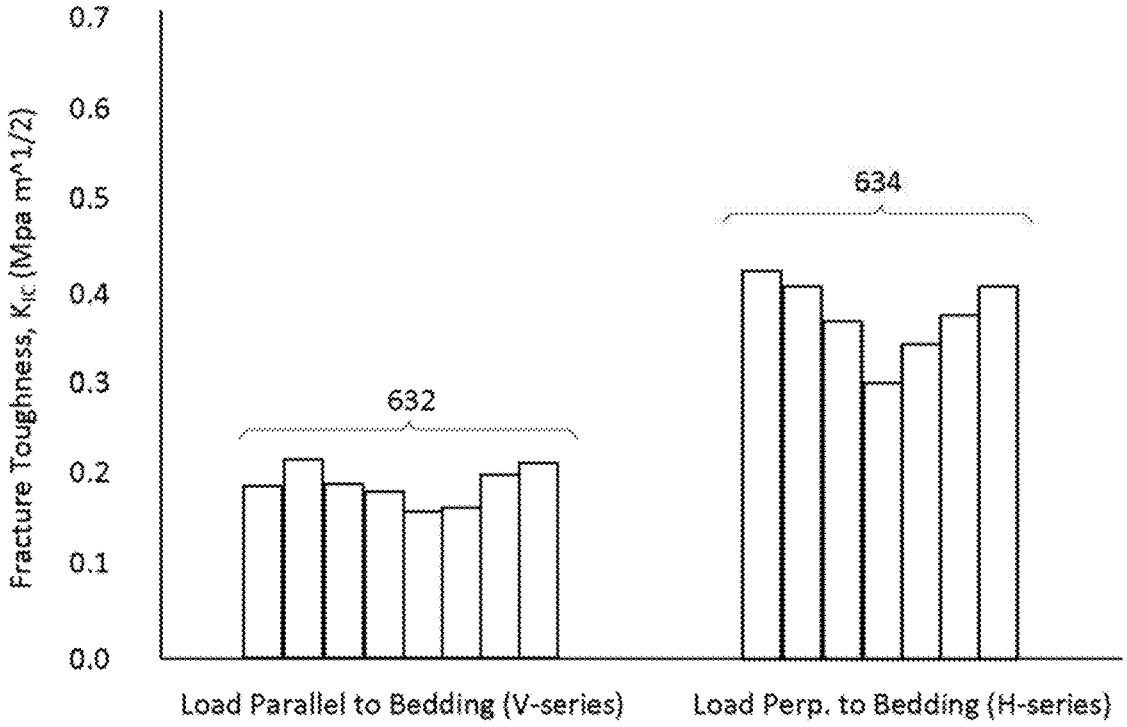

With regard to the generation of load-displacement plots, FIGS. 6B-6E are diagrams that illustrate additional example load-displacement plots for drill cutting specimens in accordance with one or more embodiments. FIG. 6B includes load-displacement diagrams for two sets of SENB samples. The five plots to the left (plots 606) correspond to crack propagation for SENB samples with a bedding plane parallel to crack growth. The five plots to the right (plots 608) correspond to crack propagation for SENB samples with a bedding plane perpendicular to crack growth. These plots illustrate significant differences in "work done" (for example, represented by the area under the load-displacement curve) measured for SENB samples of a same size and geometry, which are attributable to the different bedding plane orientations. It can be determined that the work done for SENB samples with a bedding plane parallel to crack growth (represented by plots 606), is significantly less than the work done for SENB samples with a bedding plane perpendicular to crack growth (represented by plots 608). FIG. 6E includes load-displacement diagrams for two additional sets of SENB samples. The eight plots to the left (plots 620) correspond to crack propagation for SENB samples with a bedding plane parallel to crack growth. The seven plots to the right (plots 622) correspond to crack propagation for SENB samples with a bedding plane perpendicular to crack growth. FIG. 6F includes a chart of work done for the load-displacement plots 620 and 622, respectively, of FIG. 6C. The eight bars to the left (bars 624) correspond to the plots 620 of FIG. 6E, and the work done for the respective SENB samples with a bedding plane parallel to crack growth. The seven bars to the right (bars 626) correspond to the plots 622 of FIG. 6E, and the work done for the respective SENB samples with a bedding plane perpendicular to crack growth. These plots further illustrate significant differences in work done measured for SENB samples of a same size and geometry, which are attributable to the different bedding plane orientations. This again demonstrates that the work done for SENB samples with a bedding plane parallel to crack growth (represented by plots 620), may be significantly less than the work done for SENB samples with a bedding plane perpendicular to crack growth (represented by plots 622). FIGS. 6G and 6H include charts of fracture toughness determined for the samples corresponding to the load-displacement plots 620 and 622 of FIG. 6C, arrived at using different methods. In FIG. 6G, the eight bars to the left (bars 628) correspond to the plots 620 of FIG. 6E, and the respective SENB samples with a bedding plane parallel to crack growth. The seven bars to the right (bars 630) correspond to the plots 622 of FIG. 6E, and the respective SENB samples with a bedding plane perpendicular to crack growth. The fracture toughness values of FIG. 6G are arrived at by way of ASTM E399 definition of fracture toughness (see, for example, John Srawley, "Wide Range Stress Intensity Factor Expressions for ASTM E 399 Standard Fracture Toughness Specimens", 1976). In FIG. 6H, the eight bars to the left (bars 632) correspond to the plots 620 of FIG. 6E, and the respective SENB samples with a bedding plane parallel to crack growth. The seven bars to the right (bars 634) correspond to the plots 622 of FIG. 6E, and the respective SENB samples with a bedding plane perpendicular to crack growth. The fracture toughness values of FIG. 6H are arrived at by way of RILEM method (see, for example, Jenq and Shah, "Determination of fracture parameters $K_{Ic}^{s}$ and $CTOD_c$) of plain concrete using three-point bend tests", 1990). Although certain methods for determining fracture toughness based on three point bend fracture test results for SENB are described for the purpose of illustration, other suitable method for determining fracture toughness can be used, such as ASTM D7779-11, 2015 or Griffith relation.

FIGS. 6C and 6D (which are enlargements of relative portions of the plots 608 and 606, respectively, near peak loading) illustrate "kinks" 610 in the respective load-displacement plots 608 and 606. For the SENB samples (especially for the case with bedding plane perpendicular to crack growth, represented by plots 608) the repeating occurrence of kinks 610 in the load-displacement plots can be associated with the presence of organic matter (OM) in the crack path attempting to arrest the crack growth. This provides a clear demonstration of the material's "anisotropy" (the material's directional dependency of material properties), which can be magnified by the use of miniaturized SENB specimens, such as those described here. While analyzing material anisotropy, testing larger core scale samples may not exhibit such distinct differences in properties. For a relatively large sample, such as a core scale sample, the energy needed to fracture the sample may be relatively large, in the order of 100's to 1000's of Joules. For a relatively small sample, such as a miniaturized SENB specimen, the energy needed to fracture the sample may be relatively small, in the order of milli-Joules. In a relatively large sample, such as a core scale sample, small fracture energy differences due to material heterogeneity, position and orientation of organic matters, or bedding plane orientations may be relatively small in relation to the overall fracture energy, and, as a result, the relatively small fracture energy differences may be lost in the "measurement noise", or otherwise not be identified. The inability to quantifiably measure the relatively small fracture energy differences may prevent the identification of certain characteristics of a load response for a sample, such as kinks in a load-displacement plot, and the identification of certain characteristics of a sample, such as heterogeneity in mineralogy and composition in organic rich shale, including the presence of OM in the sample associated with kinks. In a relatively small sample, such as a miniaturized SENB specimen, the small fracture energy differences due to material heterogeneity, position and orientation of organic matters, or bedding plane orientations may not be relatively small in relation to the overall fracture energy, and, as a result, the relatively small fracture energy differences may be easily identified, and not be lost in measurement noise. The ability to quantifiably measure the relatively small fracture energy differences may enable the identification of certain characteristics of a load response for a sample, such as kinks in a load-displacement plot, and the identification of certain characteristics of a sample, such as heterogeneity in mineralogy and composition in organic rich shale, including the presence of OM in the sample associated with kinks. Another benefit of using miniaturized SENB specimens is that the variables above can be characterized quantitatively and can be used to isolate the mechanical role of individual constituents present in a complex rock matrix (for example, for shale rock with non-clay minerals like, quartz, pyrites, feldspar, and clays, and organic matter such as kerogen).

In some embodiments, the fracture toughness of a drill cutting specimen 172 can be determined based on fracture toughness measurements for the drill cutting specimen 172 obtained during "notch beam testing" of the drill cutting specimen 172 in the three-point bend test drill cutting specimen test apparatus 500. For example, the fracture toughness of a drill cutting specimen 172 can be determined based on the load-displacement measurements (for example, the load-displacement plot) for the drill cutting specimen 172. Relevant parameters, such as applied load, loading displacement and crack mouth opening displacement, can be determined from the load-displacement measurements, and the fracture toughness can be determined from the relevant parameters. For example, the fracture toughness for the drill cutting specimen 172 can be determined according to ASTM E399-12 for linear elastic deformation or according to J-integral method for elastic plastic deformation, using the relevant parameters for the drill cutting specimen 172 obtained via the notch beam testing of the drill cutting specimen 172.

In some embodiments, such testing and determinations of fracture toughness can be repeated for any number of drill cutting specimens 172 prepared from drill cuttings 142 obtained from a given depth in the formation 104 (or "formation depth") to determine a corresponding fracture toughness of the formation 104 at the depth. Also, in some embodiments, such testing and determinations can be repeated for drill cutting specimens 172 prepared from drill cuttings 142 obtained from different depths in the wellbore 110 and the formation 104 to determine a corresponding fracture toughness of the formation 104 at each of the different depths. The fracture toughness determined for each of the different formation depths can be combined to generate a fracture toughness log 180 (see FIG. 1) for the well 108. The fracture toughness log 180 may include a mapping of fracture toughness of the formation 104 versus depth in the formation 104 or the wellbore 110.

Given the ability to continually acquire drill cuttings 142 directly from the drilling fluid 140 while a drilling operation is in progress, and the ability to prepare and test the drill cutting specimens 172 to obtain accurate measures of fracture toughness, in some embodiments, the described operations can be performed during a drilling operation including drilling of a wellbore into a formation, to provide a real-time assessment of fracture toughness of the formation during the drilling operation. Such a "real-time" assessment can include preparing, testing and determining fracture toughness for one or more drill cutting specimens 172 within minutes or hours (for example, within 10 minutes, 15 minutes, 30 minutes, 1 hour, 2 hours, 3 hours or 4 hours) of the corresponding drill cuttings 142 being extracted from the drilling fluid 140. For example, where the well assessment facility 160 is on-site, a fracture toughness log for a well 108 can be generated at the well assessment facility 160 during an ongoing drilling operation, using drill cutting specimens 172 prepared directly from drill cuttings 142 obtained from the drilling fluid 140 circulated during drilling of the wellbore 110 of the well 108. Thus, fracture toughness logging of a well can be accomplished in real-time, and without conducting any specialized downhole logging or coring operations. As a result, fracture toughness logging of a well may be accomplished with only the added costs of preparing and testing the drill cutting specimens, and without the added costs of downhole logging or coring operations, or the need to suspend drilling operations to conduct downhole logging or coring operations.

In some embodiments, certain well operations are controlled, or other actions are taken, based on the fracture toughness determinations. For example, a drilling operator may plan or control a drilling operation for the well 108 (or another well in the formation 104), based on the fracture toughness log 180 for the well 108 generated using the embodiments described. For example, a drilling operator may make real-time decisions for controlling an ongoing drilling of the wellbore 110 of the well 108 (for example, add lost circulation materials (LCM) to the drilling fluid 140) based on fracture toughness determinations for the formation made in real-time, as the wellbore 110 is being drilled. As another example, a well operator may plan or execute a fracturing operation for the formation 104 (for example, injecting a substance into the formation 104 to fracture the formation 104) based on the fracture toughness log 180 for the well 108 generated using the embodiments described. The measure of fracture toughness of formation rock is related to the fracability of the formation 104 (for example, the ability of the formation to be fractured) and hence the fracability of the well 108. In some embodiments, a fracture toughness log for a well 108 can be generated using embodiments described here (for example, using drill cuttings from different depths and corresponding SENB specimens), the fracture toughness log can be used to design an optimum drilling direction or fracturing plan for the well 108 (or another well in the formation 104), and the well 108 (or another well in the formation 104) can be drilled with a wellbore trajectory that follows the optimum drilling direction or fracturing operations in accordance with the fracturing plan can be conducted for the well 108 (or another well in the formation 104). Landing of a well in a pay zone (for example, a reservoir or portion of a reservoir that contains economically producible hydrocarbons) can be addressed using the embodiments described here. While fracking a zone with high TOC % is more problematic than a zone with low total organic carbon percentage (TOC %), high TOC % provides more potential for hydrocarbon production. The described embodiments can help to identify the regions of low and high TOC % by measuring fracture toughness of rock as a function of TOC %. An optimum drilling direction or fracturing plan for the well 108 (or another well in the formation 104) can be generated based on the identified regions of low and high TOC %.

Figure 8:
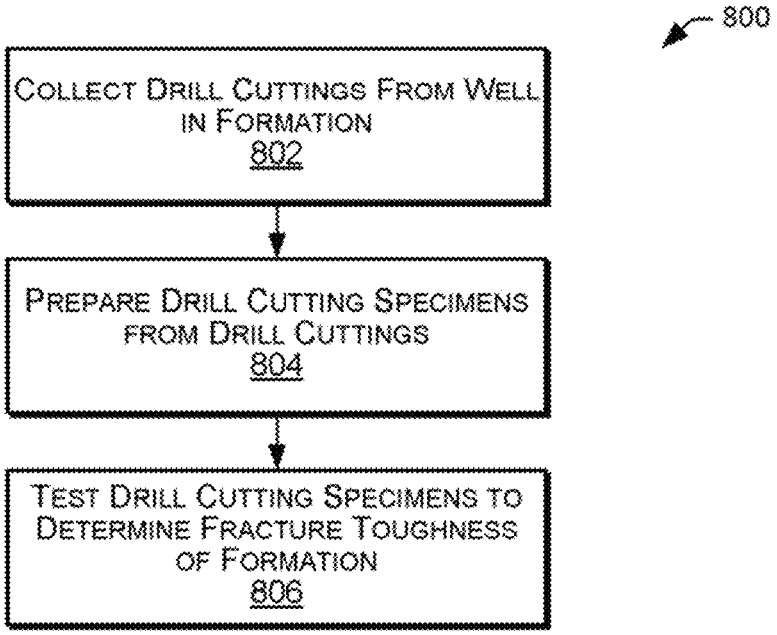
FIG. 8 is a flowchart that illustrates a method of determining fracture toughness of a formation in accordance with one or more embodiments.

FIG. 8 is a flowchart that illustrates a method 800 of determining fracture toughness of a formation in accordance with one or more embodiments. Method 800 may generally include collecting drill cuttings from a well in the formation (block 802), preparing drill cutting specimens from the drill cuttings collected (block 804), and testing the drill cutting specimens to determine fracture toughness of the formation (block 806).

In some embodiments, collecting drill cuttings from a well in the formation (block 802) includes collecting drill cuttings from a drilling fluid circulated into a wellbore of the well during drilling of a wellbore of the well. For example, collecting drill cuttings from the well 108 in the formation 104 may include collecting drill cuttings 142 filtered by the separator 152 from the drilling fluid 140 circulated into the wellbore 110 of the well 108 during drilling of the wellbore 110. The drill cuttings 142 collected may be of sufficient size (for example, be as large as or larger than the specified dimensions of the drill cutting specimen 172) to enable the drill cutting specimen 172 to be cut therefrom. Each of the drill cuttings 142 may be determined to have been cut from a given depth in the formation 104, for example, based on the drill cuttings 142 arriving to the surface within a given period of time after the drill bit 132 was determined to be at that given depth in the formation 104. For example, if it is determined that the drill bit 132 is at a depth of 1,000 m in the formation 104 at a time of 1:00 pm, and it is estimated that it takes about 10 minutes for the dirty drilling fluid 140 to travel from the drill bit 132 to the surface 112, then drill cuttings 142 extracted from the drilling fluid 140 that reaches the surface 112 at about 1:10 pm may be associated with the formation depth of 1,000 m. Such a process can be repeated at different times (for example, every 10 minutes, every 30 minutes, every hour, or every 5 hours of drilling operations) to collect multiple sets of drill cuttings 142 that are each associated with different depths. For example, a first set of drill cuttings 142 extracted from the drilling fluid 140 that reaches the surface 112 at about 1:10 pm may be associated with the formation depth of 1,000 m, a second set of drill cuttings 142 extracted from drilling fluid 140 that reaches the surface 112 at about 2:10 pm may be associated with a formation depth of 1,100 m, and so forth.

In some embodiments, preparing drill cutting specimens from the drill cuttings collected (block 804) includes fabricating drill cutting specimens from the drill cuttings collected. For example, preparing drill cutting specimens 172 from the drill cuttings 142 collected may include using cutting and polishing devices of the fabrication system 162 at the well assessment facility 160, to cut and shape, from the drill cuttings 142, one or more drill cutting specimens 172. In some embodiments, preparing a drill cutting specimen includes preparing a drill cutting specimen 172 of a SENB beam shape. Referring to FIGS. 3A and 3B, a prismatic SENB beam shaped drill cutting specimen 172 may have a length (L), a width (W) and thickness (B), and having a single notch 300 extending into the drill cutting specimen 172. In some embodiments, the dimensions of the drill cutting specimen 172 may conform to one or more testing standards, such as ASTM E 399-12. According to ASTM 399-12, for example, the length (L) may be about 3 to 5 times the width (W), the thickness (B) may be ½ of the width (W), and the notch depth (a) may be about 20% to 30% of the width (W). In some embodiments, the drill cutting specimen 172 is a relatively small (or "miniature") SENB rock specimen, having a volume in the range of about $10^{-8}$ $m^3$ to about $10^{-10}$ $m^3$. In some embodiments, the drill cutting specimen 172 is a miniature SENB rock specimen of the millimeter scale, having a length (L) in the range of about 1 mm to 100 mm. For example, the drill cutting specimen 172 may be a prismatic beam having a length (L) of about 8 mm, a width (W) of about 3 mm, a thickness (B) of about 2.3 mm, and a notch depth (a) of about of about 1 mm. In such an embodiment, selection of the corresponding drill cutting 142, can include selecting a drill cutting 142 having a portion that is equal to or larger (for example, 10% larger) than 8 mm×3 mm×2.3 mm.

In some embodiments, preparing a drill cutting specimen includes preparing a drill cutting specimen 172 with a bedding plane in a particular orientation. For example, a drill cutting specimen 172 may be prepared with a bedding plane that is perpendicular to or parallel to the loading direction. For example, referring to FIGS. 4A and 4B, where the loading direction is applied parallel with the notch 300, the drill cutting specimen 172 may be prepared with a bedding plane that is perpendicular to or parallel to the notch 300. In some embodiments, one or more of the drill cutting specimens 172 associated with a given formation depth are prepared with a first orientation (for example, with a bedding plane that is perpendicular to the loading direction) and one or more of the drill cutting specimens 172 also associated with the given formation depth are prepared with a second orientation (for example, with a bedding plane that is parallel to the loading direction). Testing drill cutting specimens 172 with different orientations that are extracted from the same formation depth can enable a determination of fracture toughness measurements for the respective orientations, at the given depth in the formation 104. In some embodiments, some of the samples are treated with an oxidizer based fluid to isolate the effects of organic materials, such as kerogen, on the measurements, and some of the samples are untreated. The oxidizer fluid may, for example, be aqueous and contain one or more oxidizers such as bromate, persulfate, peroxide, or permanganate. The oxidizer fluid may also include additives such as clay inhibitor, surfactant, or other components which modify the pH or catalyze the oxidation reaction. The differences in measurements for the treated samples and the untreated samples can be used, for example, to determine the effects of organic material on overall fracture toughness measurements and directional values (or "anisotropy"). In some embodiments, for each set of drill cutting specimens 172 associated with a given formation depth, one or more of the drill cutting specimens 172 of the set may be prepared with a bedding plane that is perpendicular to the loading direction and be treated with an oxidizer based fluid, one or more of the drill cutting specimens 172 of the set may be prepared with a bedding plane that is perpendicular to the loading direction and not be treated with an oxidizer based fluid, one or more of the drill cutting specimens 172 of the set may be prepared with a bedding plane that is parallel to the loading direction and be treated with the oxidizer based fluid, and one or more of the drill cutting specimens 172 of the set may be prepared with a bedding plane that is parallel to the loading direction and not be treated with an oxidizer based fluid. Such a set of drill cutting specimens 172 can enable the determination of the individual and combined effects of bedding plane direction and organic materials at the formation depth associated with the set of drill cutting specimens 172.

In some embodiments, testing the drill cutting specimens to determine fracture toughness of the formation (block 806) includes testing one or more drill cutting specimens associated with one or more formation depths to determine fracture toughness of the formation at each of the one or more formation depths. For example, where multiple sets of drill cutting specimens 172 are each associated with a different formation depth, testing the drill cutting specimens to determine fracture toughness of the formation may include testing one or more drill cutting specimens 172 of a first set of the sets of drill cutting specimens 172 to determine a fracture toughness of the formation at a first formation depth (for example, 1,000 m) associated with the first set of drill cutting specimens 172, testing one or more drill cutting specimens 172 of a second set of the sets of drill cutting specimens 172 to determine a fracture toughness of the formation at a second formation depth (for example, 1,100 m) associated with the second set of drill cutting specimens 172, and so forth.

In some embodiments, testing of a drill cutting specimen 172 includes conducting a three-point bend test on the drill cutting specimen 172. For example, referring to FIG. 5A, testing of a drill cutting specimen 172 may include operating the loading ram 504 to press against a first side of the drill cutting specimen 172 (the side opposite the notch 300) to generate a loading force (P), and the two supports 502 may each provide an opposing supportive force (P/2) to a second side of the drill cutting specimen 172. The loading force (P) can be continually increased, and propagation of a crack 508, extending from the notch can be measured, for example, by the measurement system 506. As described, the measurement system 506 may include, for example, a high-speed and high-definition camera and image processing software that visually monitors and measures the propagation of the crack 508. The camera and software may be synchronized to the loading ram 504 such that it obtains the instantaneous value of the loading force (P) over the duration of the test, and generates a log of the crack propagation (for example, a measured length of the crack 508) versus the corresponding loading force (P) over the duration of the testing of the drill cutting specimen 172. In some embodiments, testing of a drill cutting specimen 172 includes generating a log of the crack propagation including, for example, a load-displacement plot (see, for example, the load-displacement plots of FIG. 6A-6E). In some embodiments, the measurement system 506 includes a computer system that is the same or similar to the computer system 1000 described with regard to at least FIG. 9.

In some embodiments, testing of a drill cutting specimen 172 includes determining the fracture toughness of the drill cutting specimen 172 based on fracture toughness measurements for the drill cutting specimen 172 obtained during the testing of the drill cutting specimen 172. For example, the fracture toughness of a drill cutting specimen 172 can be determined based on the load-displacement measurements (for example, the load-displacement plot) for the drill cutting specimen 172 obtained during notch beam testing of the drill cutting specimen 172 in the three-point bend test drill cutting specimen test apparatus 500. Relevant parameters, such as applied load, loading displacement, and crack mouth opening displacement, can be determined from the load-displacement measurements, and the fracture toughness can be determined from the relevant parameters. For example, the fracture toughness for the drill cutting specimen 172 can be determined according to ASTM E399-12 for linear elastic deformation or according to J-integral method for elastic plastic deformation, using the relevant parameters for the drill cutting specimen 172 obtained via the notch beam testing of the drill cutting specimen 172.

Such testing and determinations of fracture toughness can be repeated for any number of drill cutting specimens 172 associated with a given formation depth of the formation 104 to determine a corresponding fracture toughness of the formation 104 at the formation depth. For example, if a first set of eight drill cutting specimens 172 associated with a first formation depth (for example, 1,000 m) are tested, the eight corresponding values of fracture toughness for the first set of eight drill cutting specimens 172 can be used to determine a fracture toughness of the formation 104 at the first formation depth. Also, such testing and determinations of fracture toughness can be repeated for any number of drill cutting specimens 172 associated with different depths in the formation 104 to determine a corresponding fracture toughness of the formation 104 at each of the different formation depths. Continuing with the above example, if a second set of four drill cutting specimens 172 associated with a second formation depth (for example, 1,100 m) are tested, the four corresponding values of fracture toughness for the second set of four drill cutting specimens 172 can be used to determine a fracture toughness of the formation 104 at the second formation depth. The fracture toughness determined for each of the different depths can be combined to generate a fracture toughness log 180 for the well 108. The fracture toughness log 180 may include a mapping of fracture toughness of the formation 104 versus depth in the formation 104 or the wellbore 110.

Figure 9:
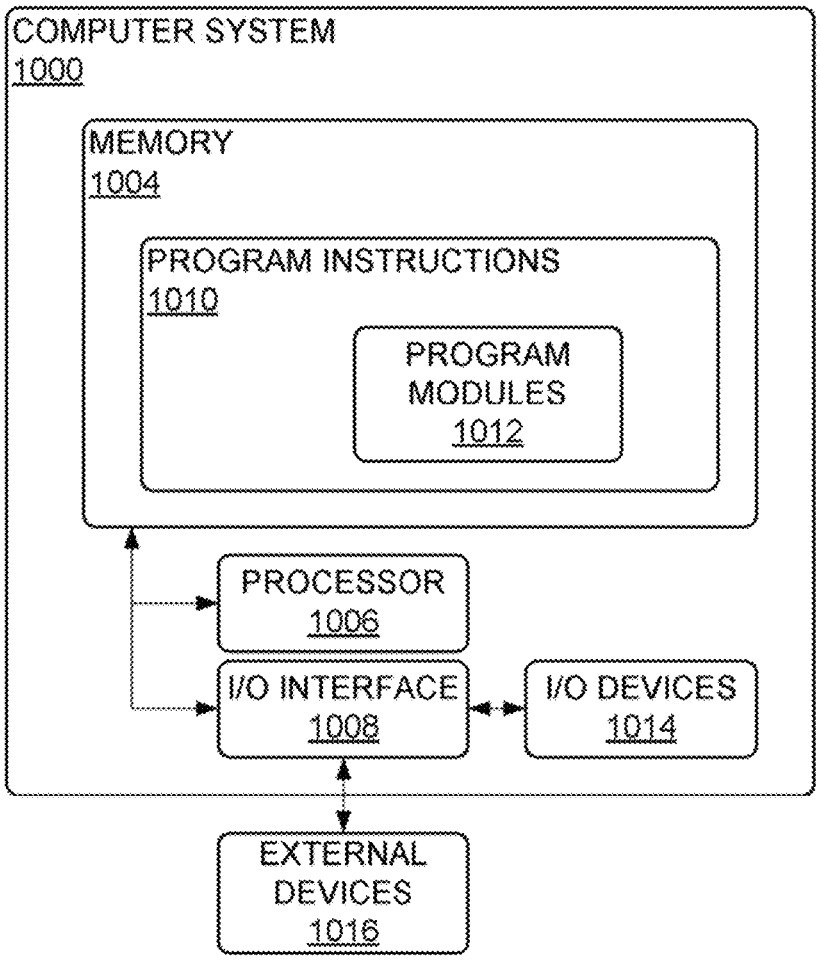
FIG. 9 is a diagram that illustrates an example computer system in accordance with one or more embodiments.

FIG. 9 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include one or more of non-volatile memory (for example, flash memory, read-only memory (ROM), programmable read-only memory (PROM), erasable programmable read-only memory (EPROM), electrically erasable programmable read-only memory (EEPROM)), volatile memory (for example, random access memory (RAM), static random access memory (SRAM), synchronous dynamic RAM (SDRAM)), and bulk storage memory (for example, compact disc read-only memory (CD-ROM), digital optical disc (DVD-ROM), or hard drives). The memory 1004 may include a non-transitory computer-readable storage medium having program instructions 1010 stored thereon. The program instructions 1010 may include program modules 1012 that are executable by a computer processor (for example, the processor 1006) to cause the functional operations described, such as those described with regard to the measurement system 506 or method 800.

The processor 1006 may be any suitable processor capable of executing program instructions. The processor 1006 may include a central processing unit (CPU) that carries out program instructions (for example, the program instructions of the program module 1012) to perform the arithmetical, logical, and I/O operations described. The processor 1006 may include one or more processors. The I/O interface 1008 may provide an interface for communication with one or more I/O devices 1014, such as a joystick, a computer mouse, a keyboard, and a display screen (for example, an electronic display for displaying a graphical user interface (GUI)). The I/O devices 1014 may include one or more of the user input devices. The I/O devices 1014 may be connected to the I/O interface 1008 via a wired connection (for example, Industrial Ethernet connection) or a wireless connection (for example, Wi-Fi connection). The I/O interface 1008 may provide an interface for communication with one or more external devices 1016, such as other computers and networks. In some embodiments, the I/O interface 1008 includes one or both of an antenna and a transceiver. In some embodiments, the external devices 1016 include the camera, and load and displacement sensors of the loading ram 504.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, etc. Portions of the processes and methods may be implemented in software, hardware, or a combination thereof. Some or all of the portions of the processes and methods may be implemented by one or more of the processors/modules/applications described here.

As used throughout this application, the word "may" is used in a permissive sense (i.e., meaning having the potential to), rather than the mandatory sense (i.e., meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (for example, via an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A method for logging fracture toughness of a geologic subsurface formation:

drilling, into a subsurface formation, a wellbore, the drilling comprising circulating a drilling fluid to capture drill cuttings generated by a drill bit cutting into the sub surface formation;

collecting, from the drilling fluid, samples of the drill cuttings captured by the drilling fluid, a first subset of the drill cuttings being associated with a first depth in the subsurface formation, and a second subset of the drill cuttings being associated with a second depth in the subsurface formation;

preparing, from the first subset of the drill cuttings, a first set of drill cutting specimens, each drill cutting specimen of the first set of drill cutting specimens comprising a miniature single edge notch beam (SENB) having a specified length, the specified length in the range of 1 millimeter (mm) to 100 mm, wherein a first subset of drill cutting specimens of the first set of drill cutting specimens are prepared to comprise a bedding plane having a first orientation, and wherein a second subset of drill cutting specimens of the first set of drill cutting specimens are prepared to comprise a bedding plane having a second orientation that is different than the first orientation;

preparing, from the second subset of the drill cuttings, a second set of drill cutting specimens, each drill cutting specimen of the second set of drill cutting specimens comprising a miniature SENB having the specified length, wherein a first subset of drill cutting specimens of the second set of drill cutting specimens are prepared to comprise a bedding plane having the first orientation, and wherein a second subset of drill cutting specimens of the second set of drill cutting specimens are prepared to comprise a bedding plane having the second orientation;

conducting three-point bend testing of the first set of drill cutting specimens to generate a first set of load-displacement measurements;

determining, based on the first set of load-displacement measurements, a first fracture toughness for the first depth in the subsurface formation;

conducting three-point bend testing of the second set of drill cutting specimens to generate a second set of load-displacement measurements;

determining, based on the second set of load-displacement measurements, a second fracture toughness for the second depth in the subsurface formation; and generating a fracture toughness log for the subsurface formation comprising a mapping of fracture toughness versus depth in the formation, the mapping comprising a mapping of the first fracture toughness to the first depth in the subsurface formation, and a mapping of the second fracture toughness to the second depth in the subsurface formation.

2. The method of claim 1, wherein each of the drill cutting specimens comprises a miniature SENB having a volume in the range of $10^{-8}$ cubic meters ($m^3$) to $10^{-10}$ $m^3$.

3. The method of claim 1, wherein each of the drill cutting specimens comprises a miniature SENB comprising a prismatic beam having a length (L) of 8 mm, a width (W) of 3 mm, a thickness (B) of 2.3 mm, and a notch having a notch depth (a) of 1 mm.

4. The method of claim 1, wherein the first orientation is aligned with a lateral axis of the drill cutting specimens such that the bedding plane is parallel to a loading direction of the drill cutting specimens in the three-point bend testing, and wherein the second orientation is aligned with a longitudinal axis of the drill cutting specimens such that the bedding plane is perpendicular to a loading direction of the drill cutting specimens in the three-point bend testing.

5. The method of claim 1, wherein a first subset of drill cutting specimens of the first set of drill cutting specimens are treated with an oxidizer based fluid to isolate the effects of organic materials, wherein a second subset of drill cutting specimens of the first set of drill cutting specimens are not treated with an oxidizer based fluid, wherein a first subset of drill cutting specimens of the second set of drill cutting specimens are treated with an oxidizer based fluid to isolate the effects of organic materials, wherein a second subset of drill cutting specimens of the second set of drill cutting specimens are not treated with an oxidizer based fluid.

6. The method of claim 1, wherein the fracture toughness log is generated in real-time during the drilling of the wellbore.

7. The method of claim 1, further comprising conducting drilling of the wellbore based on the fracture toughness log.

8. The method of claim 7, wherein conducting drilling of the wellbore comprises adding lost circulation materials (LCM) to drilling fluid circulated into the wellbore during drilling of the wellbore.

9. The method of claim 1, further comprising conducting a well stimulation operation based on the fracture toughness log.

10. The method of claim 9, wherein conducting a well stimulation operation comprises conducing a fracturing operation comprising injecting a substance into the formation to fracture the formation.

11. A method of determining fracture toughness of a geologic subsurface formation:

drilling, into a subsurface formation, a wellbore, the drilling comprising circulating a drilling fluid to capture drill cuttings generated by a drill bit cutting into the subsurface formation;

collecting, from the drilling fluid, samples of the drill cuttings captured by the drilling fluid, a first subset of the drill cuttings being associated with a first depth in the subsurface formation;

preparing, from the first subset of the drill cuttings, a first set of drill cutting specimens, each drill cutting specimen of the first set of drill cutting specimens comprising a miniature single edge notch beam (SENB) having a specified length, the specified length in the range of 1 millimeter (mm) to 100 mm, wherein a first subset of drill cutting specimens of the first set of drill cutting specimens are prepared to comprise a bedding plane having a first orientation, and wherein a second subset of drill cutting specimens of the first set of drill cutting specimens prepared to comprise a bedding plane having a second orientation that is different than the first orientation;

conducting three-point bend testing of the first set of drill cutting specimens to generate a first set of load-displacement measurements;

determining, based on the first set of load-displacement measurements, a first fracture toughness for the first depth in the subsurface formation; and generating a fracture toughness log for the subsurface formation comprising a mapping of fracture toughness versus depth in the formation, the mapping comprising a mapping of the first fracture toughness to the first depth in the subsurface formation.

12. The method of claim 11, wherein a second subset of the drill cuttings is associated with a second depth in the subsurface formation, the method further comprising:

preparing, from the second subset of the drill cuttings, a second set of drill cutting specimens, each drill cutting specimen of the second set of drill cutting specimens comprising a miniature SENB having the specified length;

conducting three-point bend testing of the second set of drill cutting specimens to generate a second set of load-displacement measurements;

determining, based on the second set of load-displacement measurements, a second fracture toughness for the second depth in the subsurface formation, wherein the mapping of the fracture toughness log comprises a mapping of the second fracture toughness to the second depth in the subsurface formation.

13. The method of claim 11, wherein each of the drill cutting specimens comprises a miniature SENB having a volume in the range of $10^{-8}$ cubic meters ($m^3$) to $10^{-10}$ $m^3$.

14. The method of claim 11, wherein each of the drill cutting specimens comprises a miniature SENB comprising a prismatic beam having a length (L) of 8 mm, a width (W) of 3 mm, a thickness (B) of 2.3 mm, and a notch having a notch depth (a) of 1 mm.

15. The method of claim 11, wherein the first orientation is aligned with a lateral axis of the drill cutting specimens such that the bedding plane is parallel to a loading direction of the drill cutting specimens in the three-point bend testing, and wherein the second orientation is aligned with a longitudinal axis of the drill cutting specimens such that the bedding plane is perpendicular to a loading direction of the drill cutting specimens in the three-point bend testing.

16. The method of claim 11, wherein a first subset of drill cutting specimens of the first set of drill cutting specimens are treated with an oxidizer based fluid to isolate the effects of organic materials, and wherein a second subset of drill cutting specimens of the first set of drill cutting specimens are not treated with an oxidizer based fluid.

17. The method of claim 11, wherein the fracture toughness log is generated in real-time during the drilling of the wellbore.

18. The method of claim 11, further comprising conducting drilling of the wellbore based on the fracture toughness log.

19. The method of claim 18, wherein conducting drilling of the wellbore comprises adding lost circulation materials (LCM) to drilling fluid circulated into the wellbore during drilling of the wellbore.

20. The method of claim 11, further comprising conducting a well stimulation operation based on the fracture toughness log.

21. The method of claim 20, wherein conducting a well stimulation operation comprises conducing a fracturing operation comprising injecting a substance into the formation to fracture the formation.

22. A method comprising:

collecting, from drilling fluid circulated in a wellbore during a drilling operation, a drill cutting generated by a drill bit cutting into a subsurface formation;

preparing, from the drill cutting, drill cutting specimens each comprising a miniature single edge notch beam (SENB) having a specified length in the range of 1 millimeter (mm) to 100 mm, wherein a first subset of the drill cutting specimens are prepared to comprise a bedding plane having a first orientation, and wherein a second subset of the drill cutting specimens are prepared to comprise a bedding plane having a second orientation that is different than the first orientation;

conducting a three-point bend testing of the drill cutting specimens to generate load-displacement measurements for the drill cutting specimens; and determining, based on the load-displacement measurements for the drill cutting specimen, a fracture toughness of the subsurface formation.

* * * * *